US005519166A

United States Patent [19]

Furuhashi et al.

[11] Patent Number: 5,519,166

[45] Date of Patent: May 21, 1996

[54] SIGNAL PROCESSING METHOD AND SOUND SOURCE DATA FORMING APPARATUS

[75] Inventors: Makoto Furuhashi, Kanagawa; Masakazu Suzuoki, Tokyo; Ken Kutaragi, Kanagawa, all of Japan

[73] Assignee: Sony Corporation, Tokyo, Japan

[21] Appl. No.: 330,329

[22] Filed: Oct. 27, 1994

Related U.S. Application Data

[63] Continuation of Ser. No. 438,088, Nov. 16, 1989, Pat. No. 5,430,241.

[30] Foreign Application Priority Data

Nov. 19, 1988 [JP] Japan ..... 63-292932
Nov. 19, 1988 [JP] Japan ..... 63-292940

[51] Int. Cl.[6] ..... G10H 7/06

[52] U.S. Cl. ..... 84/603; 84/616

[58] Field of Search ..... 84/603–607, 615, 84/616, 621, 622, 627, 653, 654, DIG. 9, 29; 341/51, 55, 60; 364/715.02, 726, 728.03

[56] References Cited

U.S. PATENT DOCUMENTS

| | | | |
|---|---|---|---|
| 4,044,204 | 8/1977 | Wolnowsky et al. | 179/1 SA |
| 4,419,897 | 12/1983 | Matsuoka | 73/660 |
| 4,433,604 | 2/1984 | Ott | 84/1.19 |
| 4,441,399 | 4/1984 | Wiggins et al. | 84/470 R |
| 4,463,650 | 8/1984 | Rupert | 84/1.19 |
| 4,602,544 | 7/1986 | Yamada et al. . | |

(List continued on next page.)

FOREIGN PATENT DOCUMENTS

| | | |
|---|---|---|
| 0207171A1 | 1/1987 | European Pat. Off. . |
| 0241922A3 | 10/1987 | European Pat. Off. . |
| 734101 | 7/1955 | United Kingdom . |
| 1021202 | 3/1966 | United Kingdom . |
| 2227859 | 8/1990 | United Kingdom . |

OTHER PUBLICATIONS

Research Disclosure 188022, Dec. 1979, pp. 681–682.

"Cubit Operating Instructions," of SoftLogic Solutions, Inc., 1987, Chapter 1, pp. 3–5.

"The Electrical Synthesis of Musical Tones," by A. Douglas, from *Electronic Engineering*, Aug. 1953, pp. 336–341.

"Signals and Systems," A. Oppenheim and A. Willsky, Prentice–Hall, Inc., 1983, pp. 226–229.

*Primary Examiner*—Brian Sircus

*Attorney, Agent, or Firm*—Limbach & Limbach; Philip M. Shaw, Jr.

[57] ABSTRACT

A method for processing a digital signal produced by digitizing an analog signal such as a musical instrument sound signal, and an apparatus for producing sound source data. When the input signal contains a periodically repetitive wave form portion, the fundamental frequency and its high harmonic components of the input signal is extracted by a comb filter prior to signal processing which takes advantage of the periodicity of the input signal. The fundamental frequency or pitch is detected by performing Fourier transform to produce frequency components, phase matching these frequency components and performing inverse Fourier transform. When extracting a repetitive waveform portion or so-called looping domain, such looping domain having the highest similarity in waveform in the vicinity of both ends of the domain is selected. When the bit compression of digital signal data is performed by selecting a filter with blocks each consisting of plural samples as units, a pseudo signal is affixed to the input signal, before the start point of the input signal, which pseudo signal will cause a filter of the lowest order to be selected. The looping domain is set so as to be a whole number multiple of the block which serves as the unit for bit compression, and the parameters of the looping start block are formed on the basis of data of the start and the end blocks. By applying a part or the whole of the signal processing method to a sound source data forming apparatus, sound source data may be formed which is reduced in the looping noise and error caused by data compression and which is of superior sound quality.

2 Claims, 15 Drawing Sheets

U.S. PATENT DOCUMENTS

| | | | |
|---|---|---|---|
| 4,627,323 | 12/1986 | Gold . | |
| 4,696,214 | 9/1987 | Ichiki . | |
| 4,734,768 | 3/1988 | Pexa | 358/135 |
| 4,748,887 | 6/1988 | Marshall . | |
| 4,755,960 | 7/1988 | Batson et al. | 364/715 |
| 4,802,225 | 1/1989 | Patterson | 381/41 |
| 4,803,908 | 2/1989 | Skinn et al. | 84/454 |
| 4,852,169 | 7/1989 | Veeneman et al. | 381/38 |
| 4,882,668 | 11/1989 | Schmid et al. | 364/600 |
| 4,890,055 | 12/1989 | Van Broekhoven et al. | 324/77 |
| 4,916,996 | 4/1990 | Suzuki et al. | 84/603 |
| 4,939,683 | 7/1990 | Van Heerden et al. | 364/715.11 |
| 4,964,027 | 10/1990 | Cook et al. | 363/40 |
| 4,982,433 | 1/1991 | Yajima et al. | 381/49 |
| 4,987,600 | 1/1991 | Rossum | 381/118 |
| 5,003,604 | 3/1991 | Okazaki et al. | 381/49 |

| | 8 BITS (1 BYTE) | | | |
|---|---|---|---|---|
| | 4 BITS | | | |
| | D7 D4 | D3 D2 | D1 | D0 |
| RF | RANGE DATA | FILTER DATA | PRESENCE OR ABSENCE OF LOOP | END |
| DA0 | DA0H | DA0L | | |
| DB0 | DB0H | DB0L | | |
| DA1 | DA1H | DA1L | | |
| DB1 | DB1H | DB1L | | |
| DA2 | DA2H | DA2L | | |
| DB2 | DB2H | DB2L | | |
| DA3 | DA3H | DA3L | | |
| DB3 | DB3H | DB3L | | |

SIGNAL PROCESSING METHOD AND SOUND SOURCE DATA FORMING APPARATUS

This is a continuation of application Ser. No. 07/438,088, filed Nov. 16, 1989, now U.S. Pat. No. 5,430,241.

BACKGROUND OF THE INVENTION

1. Field of the Invention

This invention relates to a signal processing method, such as a method for extracting various data from an input signal or a method for compressing or recording data, and a sound source data forming apparatus. More particularly, it relates to a method for processing signals, such as pitch detection or filtering of input musical sound signals, data compression on a block-by-block basis and extraction of waveform repetition periods, by a so-called digital signal processor (DSP), and an apparatus for forming sound source data by these methods.

2. Description of the Prior Art

In general, a sound source used in an electronic musical instrument or a TV game unit may be roughly classified into an analog sound source composed of, for example, VCO, VCA and VCF, and a digital sound source, such as a programmable sound generator (PSG) or a waveform ROM read-out type sound source. As a kind of such digital sound source, there has recently become extensively known a sampler sound source which is the sound source data sampled and digitized from live sounds of musical instruments and stored in a memory.

Since a large capacity memory is generally required for storing sound source data, various techniques have been proposed for memory saving. Typical of these are a looping technique which takes advantage of the periodicity of the waveform of the musical sound, and bit compression, for example by non-linear quantization.

The above mentioned looping is also a technique for producing a sound for a longer time than the original duration of the sampled musical sound. In the waveform of, for example, a musical sound, a non-tone component, such as the noise of a key stroke in a piano or the breath noise of a wind musical instrument is contained in the waveform and hence a formant portion with inexplicit waveform periodicity is formed. After this formant portion, the waveform starts to be repeated at a basic period corresponding to the interval, that is, the pitch or sound height, of the musical sound. By repeatedly reproducing n periods of the repetitive waveform, n being an integer, a sound to be sustained for a long time may be produced with a lesser memory capacity.

The above described looping is beset with a problem of a noise peculiar to looping which is known as looping noise. This looping noise is produced at the time of switching the loop waveform and exhibits a spectral distribution of frequency characteristics. For this reason, it is conspicuous even if the noise level is lower than that of ordinary white noise. Several factors are thought to be responsible for such looping noise.

One of the factors is that the looping period is not fully coincident with the period of the waveform of the source of the musical signals. For example, when a source of 401 kHz is looped at a period of 400 Hz, the looped waveform has only frequency components equal to an integer multiple of the looping period. Thus the fundamental frequency of the source is forcibly shifted to 400 Hz with the distortion presenting itself as harmonics having the frequencies of 800 Hz, 1600 Hz, etc. It can be demonstrated that, when there is an offset of 1% between the source frequency and the looping frequency, a n'th order harmonic component of $$C_n=(\sin(n-0.01))/(\pi(n-0.01)) \quad \text{(a)}$$

is produced during looping and heard as looping noise.

Another factor produced by non-integral order harmonics is k'th order harmonics, where k is a non-integral number, which are contained in the source. The source waveform, while apparently periodic, is strictly not a periodic function, but contains several non-integral order harmonics. During looping, these harmonics are forcibly shifted to the neighboring non-integral order harmonics. The distortion caused during looping is heard as the looping noise. In the case of looping harmonic overtones having the frequency component which is a times as high as the looping frequency, where a is not necessarily an integral number, the distortion factor of the distortion produced by looping is expressed as the function of a and given by $$E(a)=\sum_{n=-\infty}^{\infty}(((a-m)^2/(a-n)^2)-1) \quad \text{(b)}$$

where m is an integer closest to a. The distortion factor becomes maximum for a=0.5, 1.5, 2.5, etc. and minimum for a=1.0, 2.0, 3.0 etc.

These two factors are thought to be mainly responsible for looping noise. In any case, looping noise is produced when the looping period is not an integral number of times of the source period.

As above, the frequency components of this looping noise has a spectral distribution and are not desirable to hear so that they should be removed to the maximum extent possible.

On the other hand, the musical sound data sampled and stored in a memory is the actual musical sound which has been directly digitized and recorded on a recording medium, so that the sound quality at the time of reproduction is determined by that at the time of sampling. For example, when the sound at the time of sampling contains a large quantity of noise components, the musical sound signal read out and reproduced from the recording medium also contains these noise components as such. When so-called vibrato is previously applied to the musical sound to be sampled, the sound is slightly frequency modulated. During looping, the sideband component produced by the frequency modulation also proves to be non-integral order harmonics so as to be reproduced as the noise.

The conventional practice in selecting the start point and the looping end point for looping has been simply to select two points of the same level, such as zero-crossing points, as the looping points.

However, such looping point selection is a difficult and time-consuming operation since a looping start and end points are repeatedly connected to each other on the trial and error basis after points having approximately equal values are selected as the looping start and end points.

It is also necessary to detect the period and the fundamental frequency or so-called pitch of the source which is the musical signal. The conventional practice for such detection is to pass the musical sound data through a low pass filter (LPF) to remove high frequency noise components from the waveform and to count the number of zero-crossing points of the waveform after passage through the LPF to find the basic frequency of the music sound data waveform to measure the pitch. However, with this method, it is necessary for the musical sound to be sustained for a prolonged time, since the pitch frequency or the frequency of a fundamental tone cannot be measured unless a large number of zero-crossing points is counted. Thus the above method cannot be applied to processing a sound of short duration.

As another method for measuring the pitch, consists of processing the musical sound data by fast Fourier transform (FFT) to detect and measure the peak of the musical sound data. However, if the frequency of the pitch or the fundamental tone is more than half the sampling frequency $f_s$, it is not possible with this method to determine the peak frequency of the fundamental tone, resulting in poor accuracy. In addition, some musical sounds may have a fundamental tone component much lower than the harmonic overtone components, in which case it is similarly difficult to determine the peak of the fundamental tone frequency efficiently.

The above mentioned bit compression of the sound source data as another technique for saving memory is discussed hereinbelow. As a practical example, bit compression encoding may be envisioned in which a filter providing highest compression ratio on a block-by-block basis, each block consisting of a plurality of samples, is selected from a group of filters.

With such a filter-selecting type bit compression and encoding system, header or parameter data such as range or filter data are annexed to each block consisting of 16 samples of the wave height value data of the musical sound waveform. The filter data is used for selecting a filter which will give the highest compression ratio, or the compression ratio which is optimum for encoding, from the three mode filters, which are, straight PCM, a first order differential filter and a second order differential filter. Of these, the first and second order differential filters prove to be IIR filters at the time of decoding or reproduction, so that, when decoding or reproducing the leading sample of a block, one and two samples preceding the block are required as the initial values.

However, when the first or second order differential filters are selected in the leading block of the sound source data, there is no preceding sample, that is, the sample before the start of sound generation, so that one or two data must be stored in a storage medium such as a memory, as initial values. The provision of a storage medium represents an increase in hardware for the decoder and is not desirable for circuit integration and resulting cost reduction.

SUMMARY OF THE INVENTION

In view of the above described status of the prior art, it is a principal object of the present invention to provide a signal processing method and a sound data forming apparatus whereby the above inconveniences may be eliminated.

It is a further object of the present invention to provide a signal recording method according to which analog signals such as musical sound signals or signals digitized from such analog signals are supplied to a comb filter which allows only the fundamental frequency component and its harmonic components to pass and the thus filtered signals are recorded on a storage medium, thereby to produce signals free of frequency components that are a non-integral number multiples of the fundamental frequency and to reduce the noise during looping.

It is a further object of the present invention to provide a pitch detection method whereby the interval or pitch of a sound source can be detected from sound source data containing a smaller number of samples with lesser fluctuations in the pitch detection accuracy caused by the frequency of the sound source data.

It is a further object of the present invention to provide a method for producing digital signals whereby the looping start and end points can be set automatically.

It is a further object of the present invention to provide a signal compressing method wherein a direct output mode is selected at the input signal start point which selects the one of several filters which will give the highest data compression ratio to make the initial values unnecessary and to simplify hardware construction.

It is a further object of the present invention to provide a data compressing and encoding method wherein, when performing looping using a bit compression and encoding system on a block-by-block basis with respect to the recording/reproducing apparatus for sound source data such as musical sound data, the looping noise may be reduced and the pitch difference in the sampled sound source data may be eliminated.

It is a futher object of the present invention to provide a method for compressing and encoding waveform data wherein, when performing encoding using a bit compressing and encoding system for compressing bits on a block-by-block basis for looping waveform data, such as musical sound data, errors otherwise produced by the bit compression may be eliminated.

It is yet another object of the present invention to provide a sound source data forming apparatus wherein, when forming sound source data by looping and bit compression of musical sound signals, looping noise may be reduced, the hardware construction may be simplified and an excellent sound quality may be obtained through elimination of errors otherwise produced at the time of bit compression.

The present invention provides a signal recording method wherein input signals such as analog signals including musical sound signals or digital signals corresponding thereto are supplied to a comb filter which allows only the fundamental frequency and integer multiple frequency components with near-by frequencies to pass and a suitable repetition waveform domain of the output signal is extracted and recorded in a recording medium, so as to reduce the noise contained in the input signal and suppress noise otherwise produced at the time of repetitive regeneration of the recorded waveform.

The present invention also provides a pitch detection method wherein an input digital signal converted from an analog signal is processed by a Fourier transform to produce various frequency components which are again processed by a Fourier transform after phase matching, and the period of the peak value of the output data is detected to find the pitch of the analog signal, so as to allow the pitch of the analog signal to be detected with high precision even with shorter samples.

The present invention also provides a method for producing a digital signal wherein an analog signal is converted into a digital signal composed of a plurality of samples, the values of evaluation functions of samples at two points spaced apart from each other a distance equal to the repetitive period of the analog signal and plural samples in their vicinity are found, and plural samples between two points bearing an affinity of the waveform are extracted as repetitive data on the basis of the evaluation function values to permit setting of the looping points easily.

The present invention also provides a signal compressing method comprising selecting either a mode of directly outputting an input signal or a mode of outputting an input signal through a filter, based upon which will give the output signal having the highest compression ratio, and transmitting the output signal. The method further comprises affixing to the input signal during a period preceding the start point of the input signal a pseudo input signal which will cause the mode of directly outputting the input signal to be selected, and processing the input signal inclusive of the pseudo input signal, whereby initial values for the leading block may be eliminated and hardware may be simplified.

The present invention also provides a data compressing and encoding method for compressing and encoding constant period waveform data, with compressing-encoding blocks, each consisting of plural samples, as units, comprising setting the number of words contained in a number n of periods of waveform data so as to be equal to a integer multiple of the number of words contained in each of said compressing-encoding blocks, so as to eliminate minute frequency gaps at the time of waveform reproduction and to reduce errors produced on shifting from one block to another at the time of bit compression on a block-by-block basis.

The present invention also provides a waveform data compressing and encoding method for compressing and encoding waveform data into compressed data words and parameters for compression, with compressing-encoding blocks, each containing a predetermined number of sample words, as units, said method further comprising forming from constant period waveform data a plurality of compressing-encoding blocks each containing a predetermined number of data words, said compressing-encoding blocks each including a start block and an end block, storing said compressing-encoding blocks in a memory and forming the parameters for said start block on the basis of data for the start block and the end block, so as to reduce looping noises otherwise produced at the time of looping from the end block to the start block.

The above and further objects and novel features of the present invention will more fully appear from the following detailed description taken in connection with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

Figure 1:
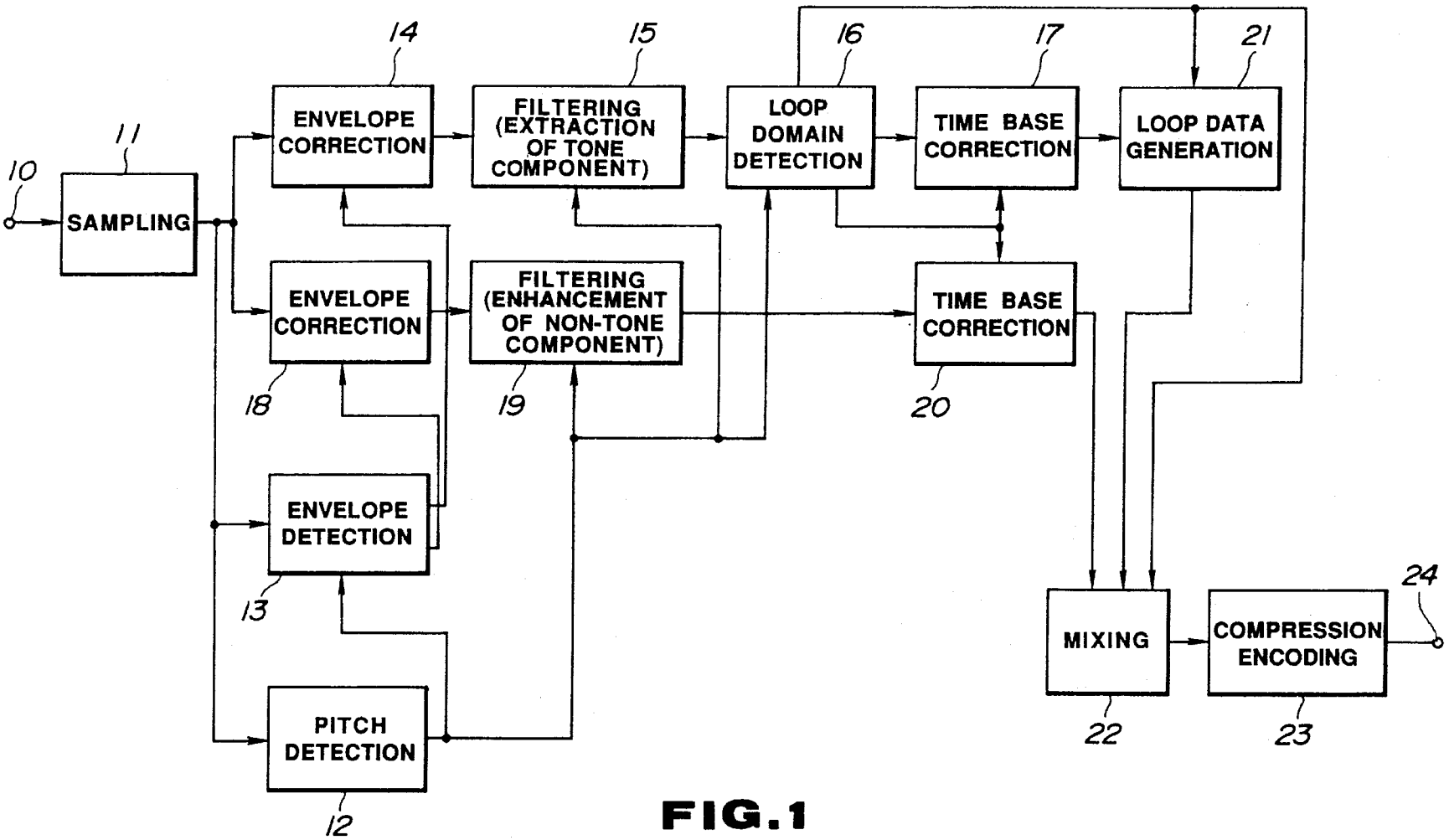
FIG. 1 is a functional block diagram showing the overall structure of a sound source data forming apparatus according to a preferred embodiment of the present invention.

By referring to the drawings, certain preferred embodiments of the present invention will be explained in detail. It is however to be understood that the present invention is not limited to these embodiments given only by way of illustration.

FIG. 1 is a functional block diagram showing a practical example of various functions which constitute input musical sound signal sampling prior to storage in a memory when the embodiment of the present invention is applied to a sound source data forming apparatus. The input musical sound signal to the input terminal 10 may for example be a signal directly picked up by a microphone or a signal reproduced from a digital audio signal recording medium as analog or digital signals.

The sound source data which is output by the apparatus of FIG. 1 has undergone a so-called looping which will now be explained by referring to the musical sound signal waveform shown in FIG. 2. In general, directly after the start of a sound generation, non-tone components such as key stroke noise on a piano or breath noise in wind musical instrument is contained in the sound, so that there is first produced a formant portion FR exhibiting inexplicit waveform periodicity which is followed by a repetition of the same waveform at the fundamental period corresponding to the musical interval (pitch or sound height) of the musical sound. An integral n number of periods of this repetitive waveform is taken as a looping domain LP which is a region or domain between a looping start point $LP_S$ and a looping end point $LP_E$. The formant portion FR and the looping domain LP are recorded on a storage medium and, for reproduction, the "formant portion is reproduced first and the looping domain LP is reproduced repeatedly to produce the musical sound for a desired time.

Referring to FIG. 1 the input musical sound signal is sampled at a sampling block 11 at, for example, a frequency of 38 kHz, so as to be taken out as 16-bit-per-sample digital data. This sampling corresponds to A/D conversion for analog input signals and to sampling rate and bit number conversion for digital input signals.

Then, at a pitch detection block 12, the fundamental basic frequency, that is the frequency of a fundamental tone $f_0$ or the pitch data, which determines the tone or pitch of the digital musical sound from the sampling block, is detected.

The principle of detection at the detection block 12 is hereinafter explained. The musical sound signal as the sampling sound source occasionally has the fundamental tone frequency markedly lower than a sampling frequency $f_s$ so that it is difficult to identify the interval or pitch with high accuracy by simply detecting the peak of the musical sound along the frequency axis. Hence it is necessary to utilize the spectrum of the harmonic overtones of the musical sound by some means or other.

The waveform f(t) of a musical sound, the interval of which is desired to be detected, may be expressed by Fourier expansion by $$f(t) = \sum_{\omega} a(\omega)\cos[\omega t + \phi(\omega)] \tag{1}$$

where $a(\omega)$ and $\phi(\omega)$ denote the amplitude and the phase of each overtone component, respectively. If the phase shift $\phi(\omega)$ of each overtone is set to zero, the above formula may be rewritten to $$\tilde{f}(t) = \sum_{\omega} a(\omega)\cos\omega t \tag{2}$$

The peak points of the thus phase-matched waveform f(t) are at the points corresponding to integer multiples of the periods of all of the overtones of the waveform f(t) and at t=0. The peaks are located only at the period of the fundamental tone.

Figure 3:
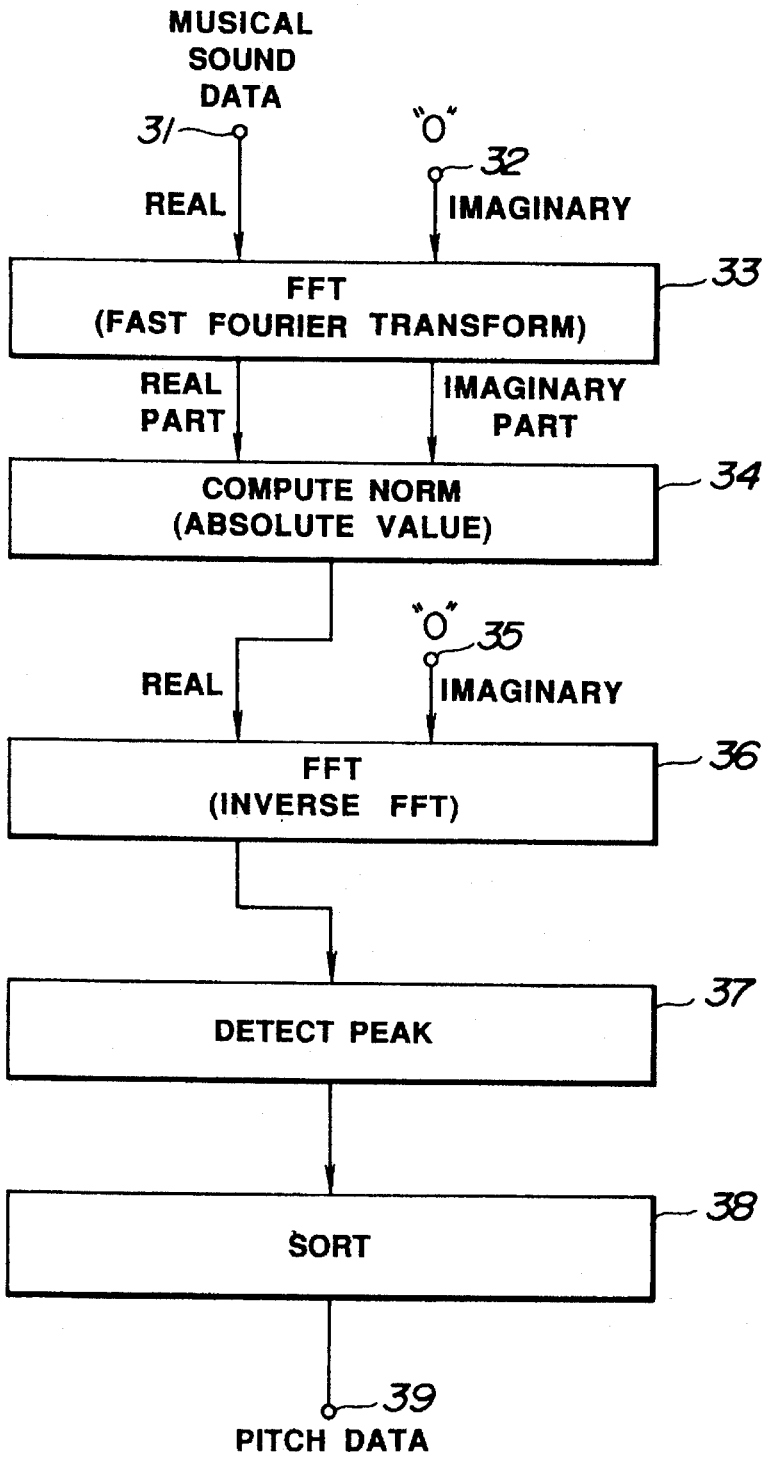
FIG. 3 is a functional block diagram for illustrating the pitch detecting operation.

On the basis of this principle, the sequence of pitch detection is explained by referring to the functional block diagram of FIG. 3.

In this figure, musical sound data and "0" are supplied to a real part input terminal 31 and an imaginary part input terminal 33 of a fast Fourier transform block 33, respectively.

In the fast Fourier transform, which is performed at the fast Fourier transform block 33, if the musical sound signal, the pitch of which is desired to be detected, is expressed as x(t), and the harmonic overtone components in the musical sound signal x(t) is expressed as $$a_n \cos(2\pi f_n t + \theta) \tag{3}$$

x(t) may be given by $$x(t) = \sum_{n=0}^{\infty} a_n \cos(2\pi f_n t + \theta) \tag{4}$$

This may be rewritten by complex notation to $$x(t) = (1/2) \sum_{n=-\infty}^{\infty} a_n \exp(j\theta_n)\exp(j\omega_n t) \tag{5}$$

where an equation $$\cos\theta = (\exp(j\theta) + \exp(-j\theta))/2 \tag{6}$$

is employed. By Fourier transform, the following equation $$\begin{aligned} X(\omega) &= \int_{-\infty}^{\infty} x(t)\exp(-j\omega t)dt \\ &= \sum_{n=-\infty}^{\infty} a_n \exp(j\theta_n)\delta(\omega - \omega_n) \end{aligned} \tag{7}$$

is derived, in which $\delta(\omega-\omega_n)$ represents a delta function.

At the next block 34, the norm or absolute value, that is, the root of the sum of a square of the real part and a square of the imaginary part of the data obtained after the fast Fourier transform, is computed.

Thus, by taking an absolute value Y(w) of X(w), the phase components are cancelled, so that $$\begin{aligned} Y(\omega) &= [X(\omega)\overline{X(\omega)}]^{1/2} \\ &= (1/2)a_n\delta(\omega - \omega_n). \end{aligned} \tag{9}$$

This is done for phase matching of all of the high frequency components of the musical sound data. The phase components can be matched by setting the imaginary part to zero.

The thus computed norm is supplied as real part data to a second fast Fourier transform block (in this case an inverse FFT block) 36 as the real part data, while "0" is supplied to an imaginary data input terminal 35, to execute an inverse FFT to restore the musical sound data. This inverse FFT may be represented by $$\begin{aligned} y(t) &= (1/2\pi)\int_{-\infty}^{\infty} Y(\omega)\exp(-j\omega t)dt \\ &= \int_{-\infty}^{\infty} a_n \cos\omega_n t \end{aligned} \tag{10}$$

The musical sound data, thus recovered after inverse FFT, are taken out as a waveform represented by the synthesis of cosine waves having phase-matched high frequency components.

The peak values of the thus restored sound source data are detected at the peak detection block 37. The peak points are the points at which the peaks of all of the frequency components of the musical sound data become coincident. At the next block 38, the thus detected peak values are sorted in the order of the decreasing values. The tone or pitch of the musical sound signal can be known by measuring the periods of the detected peaks.

Figure 4:
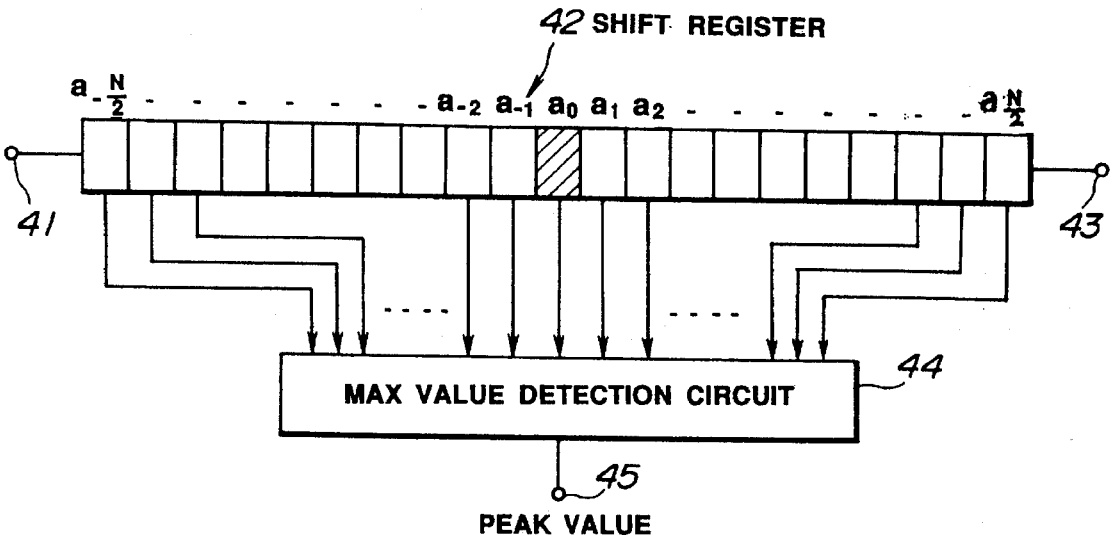
FIG. 4 is a block diagram for illustrating the peak detecting operation.

FIG. 4 illustrates an arrangement of the peak detection block 37 of FIG. 3 for detecting the maximum value or peak of the musical sound data.

It will be noted that a large number of peaks with different values are present in the musical sound data, and the interval or pitch of the musical sound can be obtained by finding the maximum value of the musical sound data and detecting its period.

Referring to FIG. 4, the musical sound data string following the inverse Fourier transform is supplied via an input terminal 41 to a (N+1) stage shift register 42 and transmitted via registers $a_{-N/2}, \ldots a_0, \ldots a_{N/2}$ in this order to an output terminal 43. This (N+1) stage shift register 42 acts as a window having a width of (N+1) samples with respect to the musical sound data string and the (N+1) samples of the data string are transmitted via this window to a maximum value detection circuit 44. That is, as the musical sound data are first entered into the register $a_{-N/2}$ and sequentially transmitted to the register $a_{N/2}$, the (N+1) sample musical sound data from the registers $a_{-N/2}, \ldots, a_0, \ldots, a_{N/2}$ are transmitted to the maximum value detection circuit 44.

This maximum value detection circuit 44 is so designed that, when the value of the central register $a_0$ of the shift register 42, for example, has turned out to be maximum among the values of the (N+1) samples, the circuit 44 detects the data of the register $a_0$ as the peak value to output the detected peak value at an output terminal 45. The width (N+1) of the window can be set to a desired value.

Figure 5:
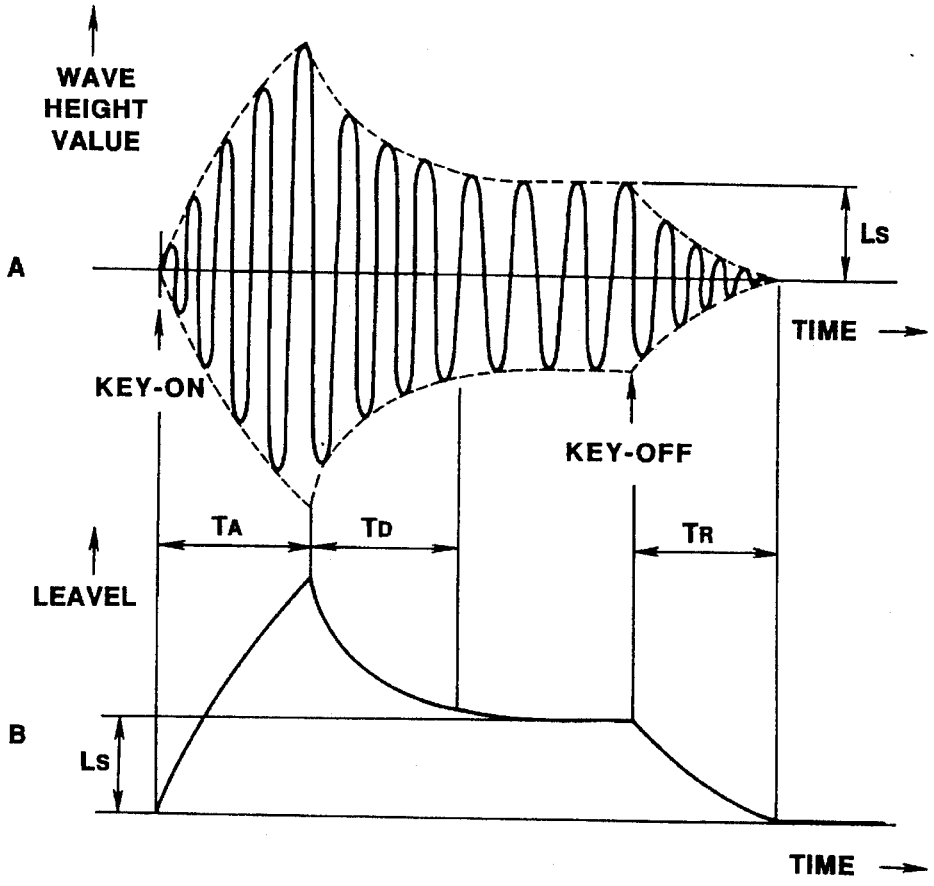
FIG. 5 is a waveform diagram for the musical sound signal and the envelope thereof.

Turning again to FIG. 1, the envelope of the sampled digital musical sound signal is detected at envelope detection block 13, using the above pitch data, to produce the envelope waveform of the musical sound signal. This envelope waveform, as shown at B in FIG. 5, is obtained by sequentially connecting the peak points of the musical sound signal waveform, as shown at A in FIG. 5, and indicates the change in sound level or sound volume with lapse of time since the time of sound generation. This envelope waveform is usually represented by parameters such as ADSR, or attack time/decay time/sustain level/release time. Considering the case of a piano tone, produced upon striking a key, as an example of the musical sound signal, the attack time $T_A$ indicates the time which elapses since a key on a keyboard is struck (key-on) until the sound volume increases and reaches the target or desired sound volume value. The decay time $T_D$ is the time which elapses since reaching the sound volume of the attack time $T_A$ until reaching the next sound volume, for example, the sound volume of a sustained sound of the piano. The sustain level $L_s$ is the volume of the sustained sound that is kept since releasing key depression until key-off. The release time $T_R$ is the time which elapses since key-off until extinction of the sound. The times $T_A$, $T_D$ and $T_R$ occasionally mean the gradient or rate of change of the sound volume. Other envelope parameters than these four parameters may also be employed.

Figure 6:
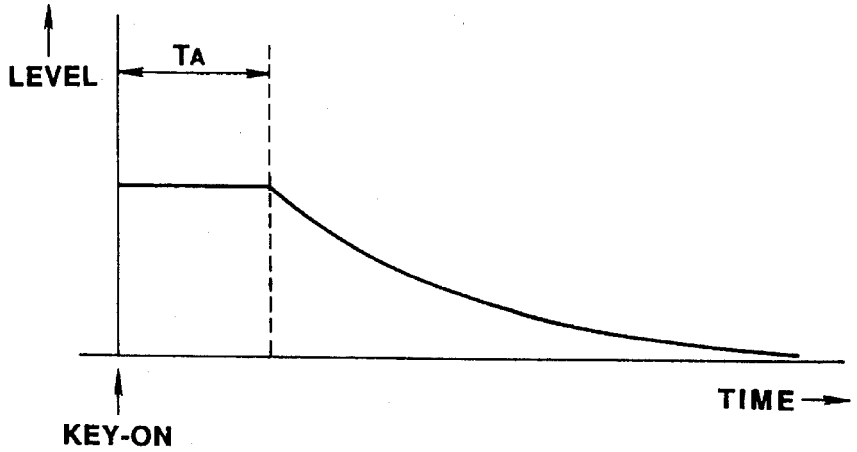
FIG. 6 is a waveform diagram for decay rate data for the musical sound signals.

It will be noted that, at the envelope detection block 13, data indicating the overall decay rate of the signal waveform is obtained simultaneously with the envelope waveform data represented by the parameters such as the above mentioned ADSR, with a view to taking out the format portion with the residual attack waveform. These decay rate data assume a reference value "1" at the time of sound generation at key-on during the attack time $T_A$ and are then decayed monotonously, as shown in FIG. 6 as an example.

Figure 7:
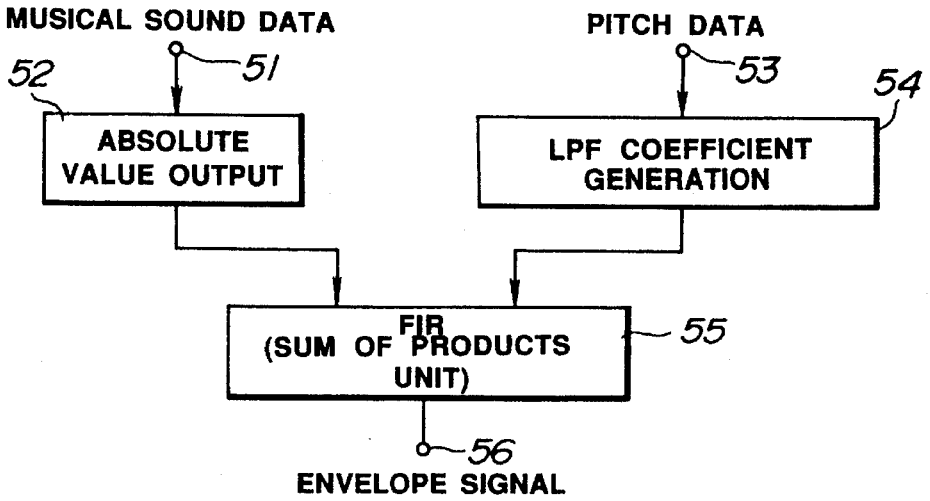
FIG. 7 is a functional block diagram for illustrating the envelope detecting operation.

An example of the envelope detection block 13 of FIG. 1 is explained by referring to the functional block diagram of FIG. 7.

The principle of envelope detection is similar to that of envelope detection of an amplitude modulated (AM) signal. That is, the envelope is detected with the pitch of the musical sound signal being considered as the carrier frequency for the AM signal. The envelope data are used when reproducing the musical sound, which is formed on the basis of the envelope data and pitch data.

The musical sound data supplied to the input terminal 51 is transmitted to an absolute value output block 52 to find the absolute value of the wave height value data of the musical sound. These absolute value data are transmitted to a finite impulse response (FIR) type digital filter block or FIR block 55. This FIR block 55 acts as a low pass filter, the cut-off characteristics of which are determined by supplying to the FIR block 55 filter coefficients previously formed in a LPF coefficients generation block 54 based on the pitch data supplied to an input terminal 53.

Figure 8:
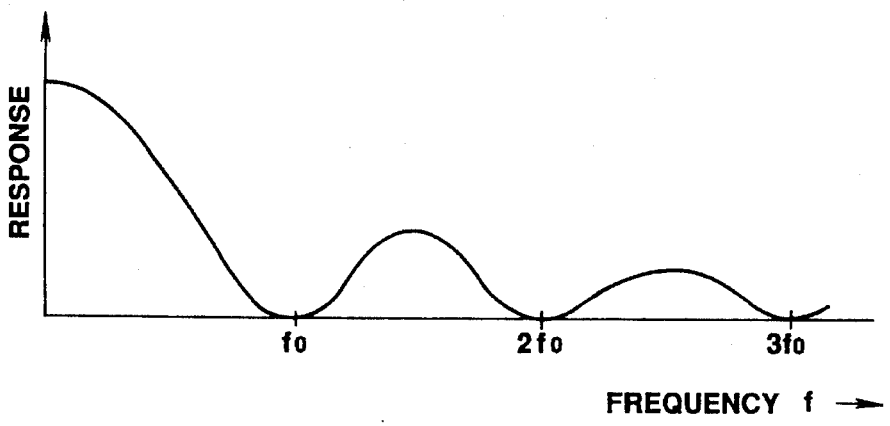
FIG. 8 is a diagram showing FIR filter characteristics.

The filter characteristics are shown in FIG. 8 as an example and have zero points at the frequencies of the fundamental tone (at a frequency $f_0$) and harmonic overtones of the musical sound signal. For example, the envelope data as shown at B in FIG. 5 may be detected from the musical sound signal shown at A in FIG. 5 by attenuating the frequencies of the fundamental tone and the overtones by the FIR filter. The filter coefficient characteristics are shown by the formula $$H(f)=k\cdot(\sin(\pi f/f_0))/f \tag{11}$$

wherein $f_0$ indicates the basic frequency or pitch of the musical sound signal.

Referring again to FIG. 1, the operation of generating the wave height signal data of the formant portion FR and the wave height signal data of the looping domain LP, i.e. the looping data from the wave height value data of the sampled musical sound signal or sampling data will now be explained.

Figure 9:
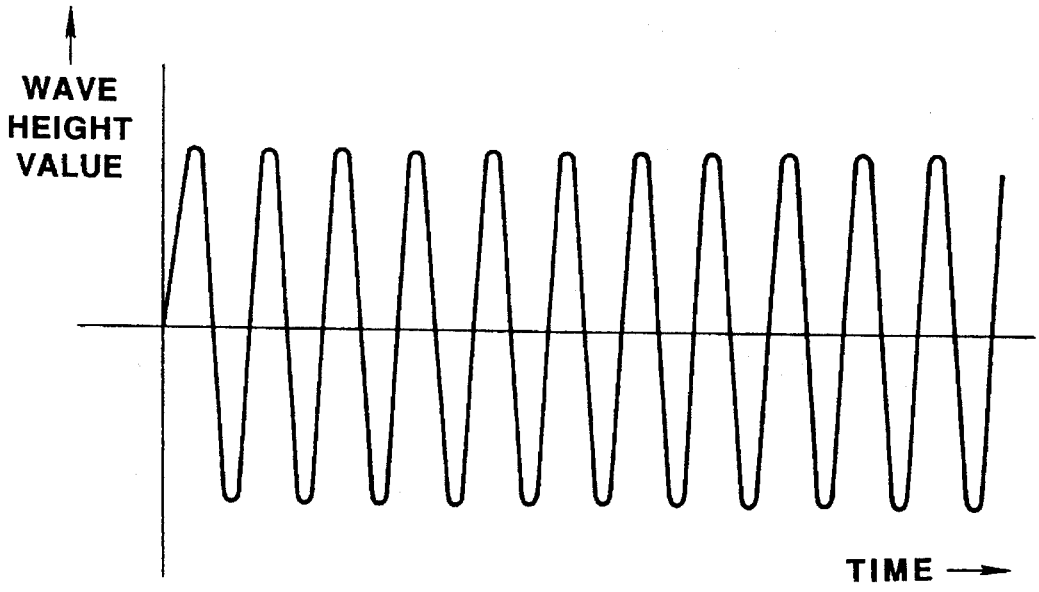
FIG. 9 is a waveform diagram showing wave height values after envelope correction of the musical sound signal.

In a first block 14 for generating the looping data, the wave height value data of the sampled musical sound signal are divided by data of the previously detected envelope waveform shown at B in FIG. 5 (or multiplied by a reciprocal of the data) to perform an envelope correction to produce wave height value data of a waveform having a constant amplitude as shown in FIG. 9. This envelope corrected signal or, more precisely, the corresponding wave height value data, is next filtered in a filtering block 15 to produce a signal or, more precisely, the corresponding wave height value data, which is attenuated at other than the tone components, or in other words, enhanced at the tone components. The tone components herein mean the frequency components that are integer multiples of the fundamental frequency $f_0$. More specifically, the data is passed through a high pass filter (HPF) to remove the low frequency components, such as vibrato, contained in the envelope corrected signal, and then through a comb filter having frequency characteristics shown by a chain-dotted line in FIG. 10, that is frequency characteristics having frequency bands that are integer multiples of the fundamental frequency $f_0$ as the pass bands, to pass only the tone components contained in the HPF signal as well as to attenuate non-tone components or noise components. The data is also passed if necessary through a low pass filter (LPF) to remove noise components superimposed on the output signal from the comb filter.

Figure 10:
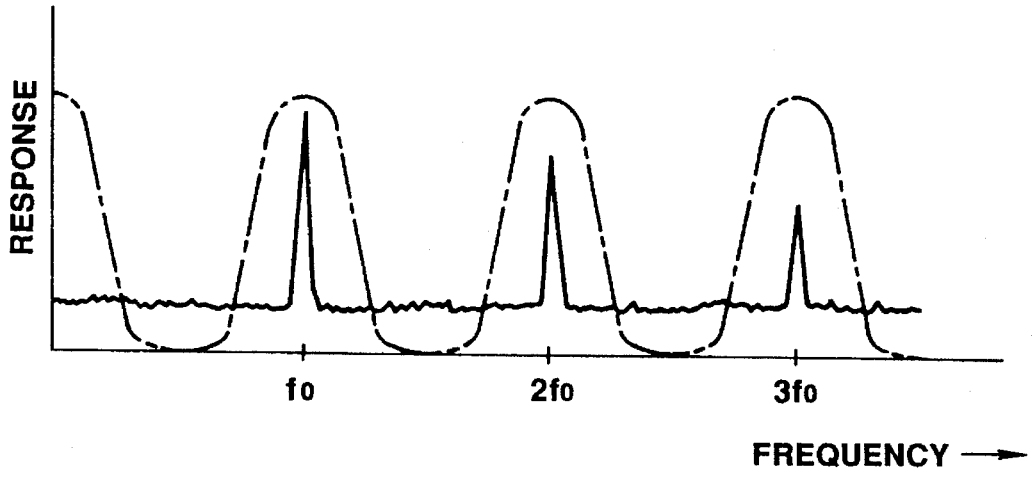
FIG. 10 is a diagram showing comb filter characteristics.

Thus, considering a musical sound signal, such as the sound of a musical instrument, as the input signal, since the musical sound signal usually has a constant pitch or tone height, it has such frequency characteristics in which, as shown by a solid line in FIG. 10, energy concentration occurs in the vicinity of the fundamental frequency $f_0$ corresponding to the pitch of the musical sound and the integer multiple frequencies thereof. Conversely, noise components in general are known to have a uniform frequency distribution. Therefore, by passing the input musical sound signal through a comb filter having frequency characteristics shown by a chain-dotted line in FIG. 10, only the frequency components that are integer multiples of the fundamental frequency $f_0$ of the musical sound signal, that is, the tone components, are passed or enhanced, whereas other components or non-tone components including a portion of the noise are attenuated, so that the S/N ratio is improved. The frequency characteristics of the comb-filter shown by a chain-dotted line in FIG. 10 may be represented by the formula $$H(f)=[(\cos(2\pi f/f_0)+1)/2]^N \tag{12}$$

wherein $f_0$ indicates the fundamental frequency of the input signal, or the frequency of the fundamental tone corresponding to the pitch or interval, and N the number of stages of the comb filter.

Figure 2:
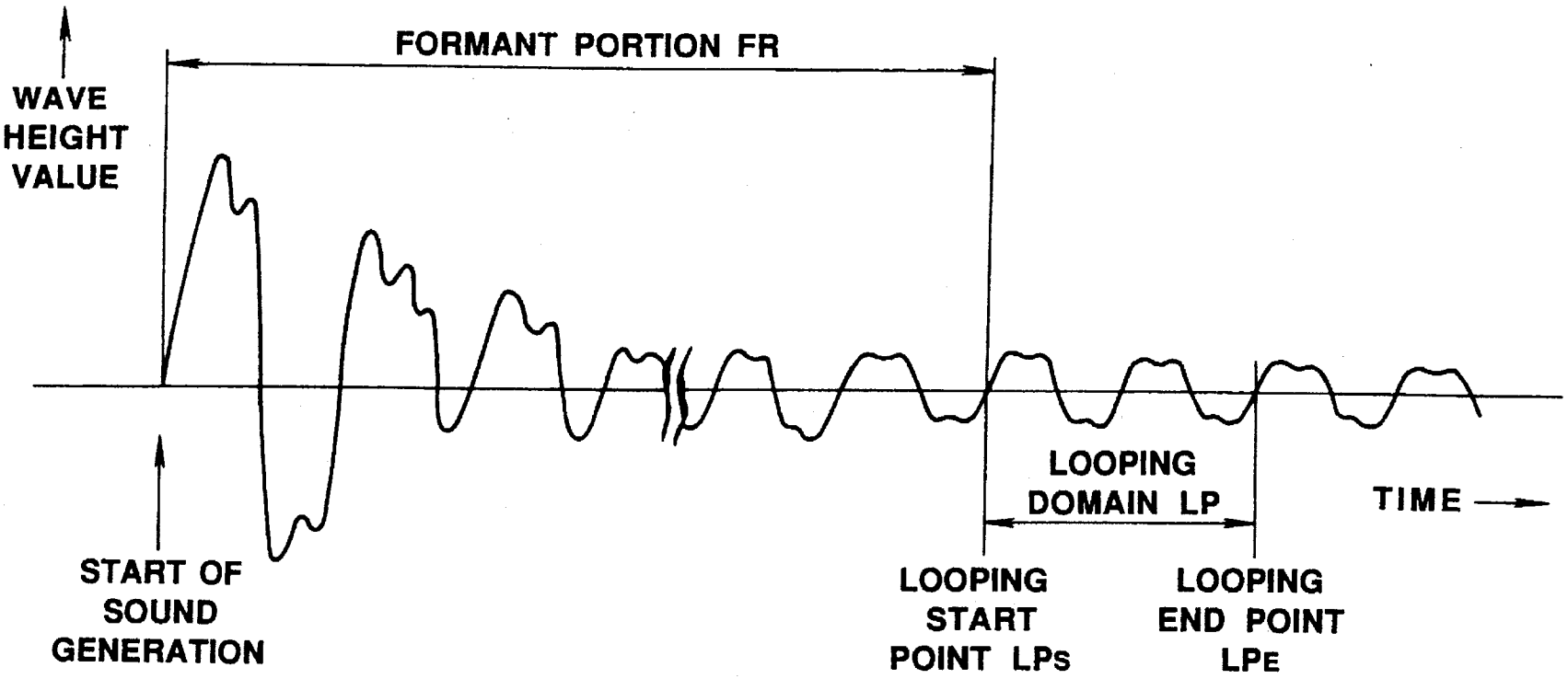
FIG. 2 is a diagram showing a waveform of musical sound signals.

The musical sound signal, having the noise component reduced in this manner, is supplied to the repetitive waveform extracting circuit in which the musical sound signal is obtained from a suitable repetitive waveform domain, such as the looping domain LP, shown in FIG. 2 and supplied to and recorded on a recording medium, such as a semiconductor memory. The musical sound signal data recorded on the storage medium has the non-tone component and a part of the noise component attenuated so that the noise at the time of repetitive reproduction of the repetitive waveform domain or looping the noise is reduced.

The frequency characteristics of the HPF, the comb filter and the LPF are set on the basis of the basic frequency $f_0$ which is the pitch data detected at the pitch detection block 12.

Figure 11:
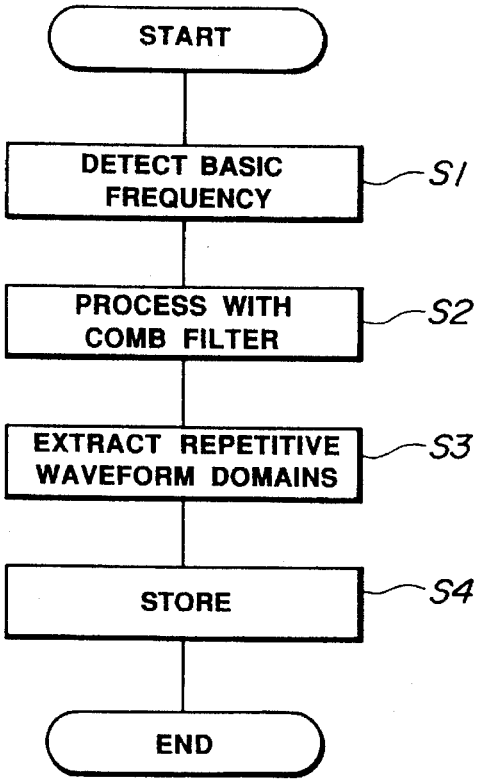
FIG. 11 is a flow chart for illustrating the signal recording method with comb filtering.

The signal recording method accompanied by the above mentioned filtering is explained in general terms by referring to FIG. 11. At step S1, the basic frequency $f_0$ of the input analog signal or the corresponding input digital signal for the musical sound signal, or pitch data, is detected. At step S2, the input analog signal is filtered through a comb filter, having the fundamental frequency band of the input signal and its harmonic components as the pass bands, to produce an output analog signal or a digital signal. At step S3, it is determined that only the fundamental frequency band and frequency bands of the harmonics of the input analog or digital signal are the pass band for which a signal is to be extracted. At step S4, the output signal can be recorded or stored.

With the above described signal recording method, the musical sound is passed through the comb filter which allows the fundamental tone and its harmonic overtones to pass. Components over than the tone components, that is, the non-tone component and the part of the noise, are attenuated to improve the S/N ratio. In case of looping, musical sound data which are attenuated in noise components are looped to support the looping noise.

At the looping domain detection block 16 of FIG. 1, a suitable repetitive waveform domain of the musical sound signal having the components other than the tone component attenuated by the above mentioned filtering is detected to establish the looping points, that is, the looping start point $LP_S$ and the looping end point $LP_E$.

In more detail, at the detection block 16, looping points are selected which are separated from each other by an integer multiple of the repetitive period corresponding to the pitch or interval of the musical sound signal. The principle of selecting the looping points is hereinafter explained.

When looping musical sound data, the looping distance must be an integer number multiple of the fundamental period which is a reciprocal of the frequency of the fundamental tone. Thus, by accurately identifying the pitch of the musical sound, the looping distance can be determined easily.

Once the looping distance is previously determined, two points spaced apart from each other by such distance are selected and the correlation of the signal waveforms in the vicinity of the two points is evaluated to establish the looping points. A typical evaluation function employing convolution or sum of products with respect to the samples of the signal waveform in the vicinity of the above two points is now explained. The operation of convolution is sequentially performed with respect to the sets of all points to evaluate the correlation or analogy of the signal waveform. In the evaluation by convolution, the musical sound data are sequentially entered to a sum of products unit made up of, for example, a digital signal processing unit (DSP) as later described, and the convolution is computed at the sum of products unit and outputted. The set of two points at which the convolution becomes maximum is adopted as the looping start point $LP_S$ and the looping end point $LP_E$.

Figure 12:
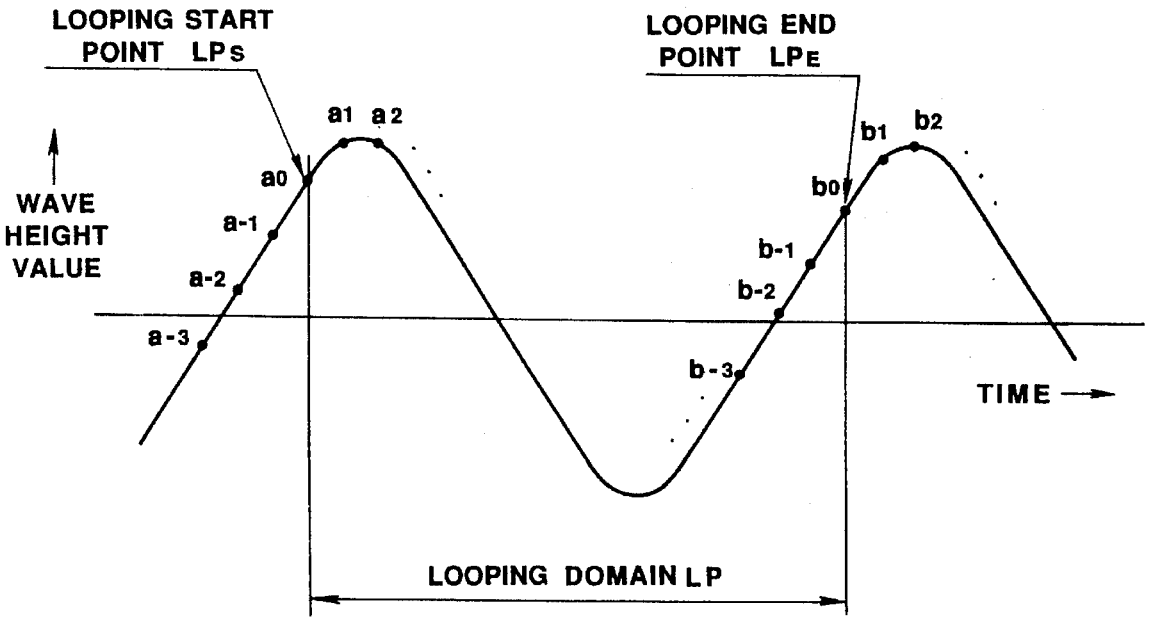
FIG. 12 is a waveform diagram for illustrating the optimum looping point setting operation.

In FIG. 12, with a candidate point $a_0$ of the looping start point $LP_S$, a candidate point $b_0$ for the looping end point $LP_E$, wave height data $a_{-N}, \ldots, a_{-2}, a_{-1}, a_0, a_1, a_2, \ldots, a_N$ at plural points, such as (2N+1) points, before and after the candidate point $a_0$ of the looping start point $LP_S$ and with wave height data $b_{-N}, \ldots, b_{-2}, b_{-1}, b_0, b_1, b_2, \ldots, b_N$ at the same number (2N+1) of points before and after the candidate point $b_0$ of the looping end point $LP_E$, the evaluation function $E(a_0, b_0)$ at this time is determined by the formula $$E(a_0,b_0) = \left( \sum_{k=-N}^{N} a_k b_k \right)^2 / \left( \sum_{k=-N}^{N} a_k^2 \sum_{k=-N}^{N} b_k^2 \right) \tag{13}$$

The convolution at or about the point $a_0$ and $b_0$ as the center is to be found from the formula (13). The sets of the candidates $a_0$ and $b_0$ are sequentially changed to find all the looping point candidates and the points for which the evaluation function E becomes maximum are adopted as the looping points.

The method of least squares of errors may also be used to find the looping points besides the convolution method. That is, the candidate points $a_0$, $b_0$ for the looping points by the method of least squares may be expressed by the formula (14)

$$\epsilon(a_0,b_0) = \sum_{k=-N}^{N} (a_k - b_k)^2 \tag{14}$$

In this case, it suffices to find the points $a_0$, $b_0$ for which the evaluation function becomes minimum.

The above described selecting operation for the optimum looping points may generally be applied to the method for producing digital signals by digitizing analog signals having repetitive periods to form looping data. The method for producing digital signals in general is hereinafter explained by referring to the flow chart of FIG. 13.

Figure 13:
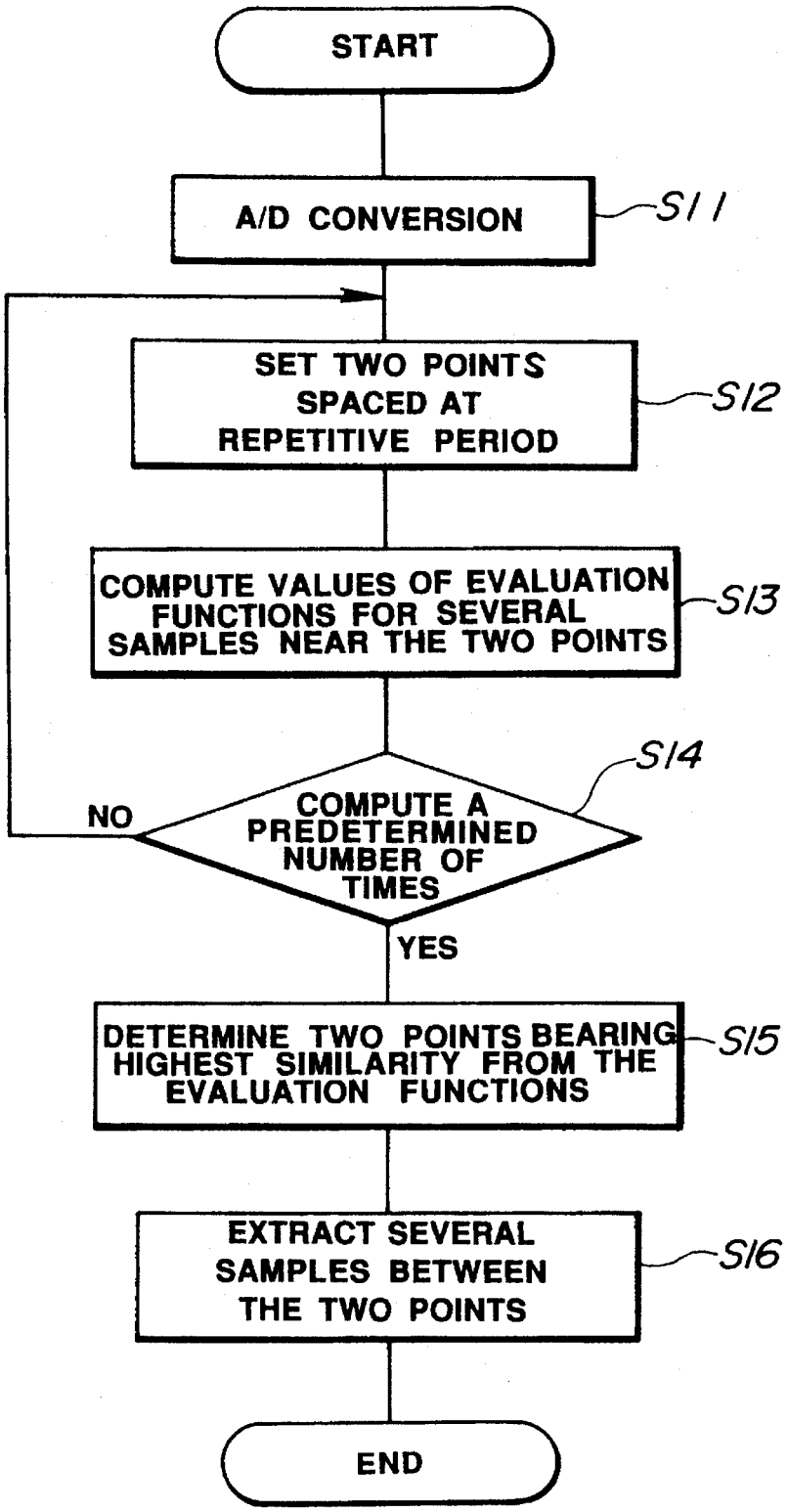
FIG. 13 is a flow chart for illustrating the digital signal forming method with optimum looping point selection.

In the flow chart shown in FIG. 13, an analog signal having repetitive waveforms is converted at step S11 into a digital signal composed of plural samples, and a sample set of two points separated from each other by the repetitive period of the analog signal is established at step S12. The values of the predetermined evaluation functions of plural samples in the vicinity of each point of the set are found at step S13. The points of the set are then moved within the effective measurement range, at step S14, while the distance between the samples is maintained, and the prescribed evaluation functions of the values of the plural in the vicinity of the samples points of the sets, which are moved a predetermined number of times, are measured. At step S15, the set of points having the strongest analogy or similarity are determined from the values of the evaluation functions. At step S16, plural samples between the two points showing the waveform analogy in the vicinity of the samples of the thus established two points are extracted as the repetitive data.

With the above described method for producing digital signals, the values of the evaluation functions of the points spaced apart from each other by the repetitive period of the analog signal and the samples in their vicinity may be measured to determine the waveform analogy or similarity of these samples.

Turning again to FIG. 1, the pitch conversion ratio is computed in the loop domain detection block 16 on the basis of the looping start point $LP_S$ and the looping end point $LP_E$.

This pitch conversion ratio is used as the time base correction data at the time of the time base correction at the next time base correction block 17. This time base correction is performed for matching the pitches of the various sound source data when these data are stored in storage means such as the memory. The above mentioned pitch data detected at the pitch detection block 12 may be used in lieu of the pitch conversion ratio.

Figure 14:
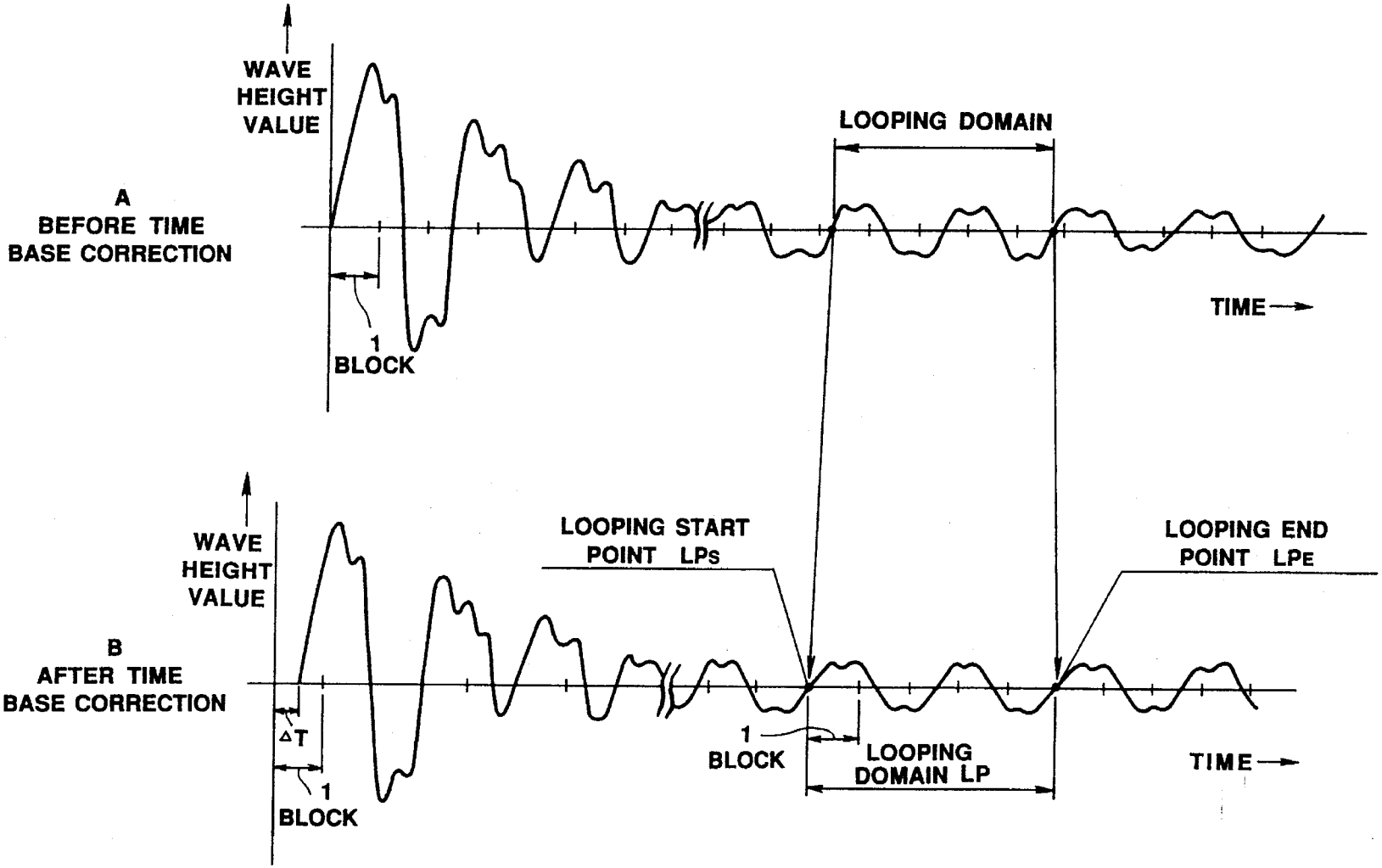
FIG. 14 is a waveform diagram showing a musical sound signal before and after time base correction.

The pitch normalization process in the time base correction block 17 is explained by referring to FIG. 14.

FIGS. 14A and B show the musical sound signal waveform before and after time base companding, respectively. The time axes of FIGS. 14A and B are guraduated by blocks for quasi-instantaneous bit compressing and encoding as later described.

In the waveform A before time base correction, the looping domain LP is usually not related with the block. In FIG. 14B, the looping domain LP is time base companded so that the looping domain LP is an integer multiple of the block length or block period. The looping domain is also shifted along time axis so that the block boundary coincides with the looping start point $LP_S$ and the looping end point $LP_E$. In other words, the time base correction, that is, the time base companding and shifting, allows the start point $LP_S$ and the end point $LP_E$ of the looping domain LP to be at the boundary of predetermined blocks, so as looping can be performed for an integral number (m) of blocks to realize pitch normalization of the source data at the time of recording.

Wave height value data "0" may be inserted in an offset period T from the block boundary of the leading end of the musical sound signal waveform caused by such time shift. These "0" data are used as pseudo data in order that lower order filters not in need of an initial value may be selected, since the higher order filter which will be selected during data compression is in need of the initial value. A more detailed explanation is given in connection with the data compression operation on the block-by-block basis shown in FIG. 21.

Figure 15:
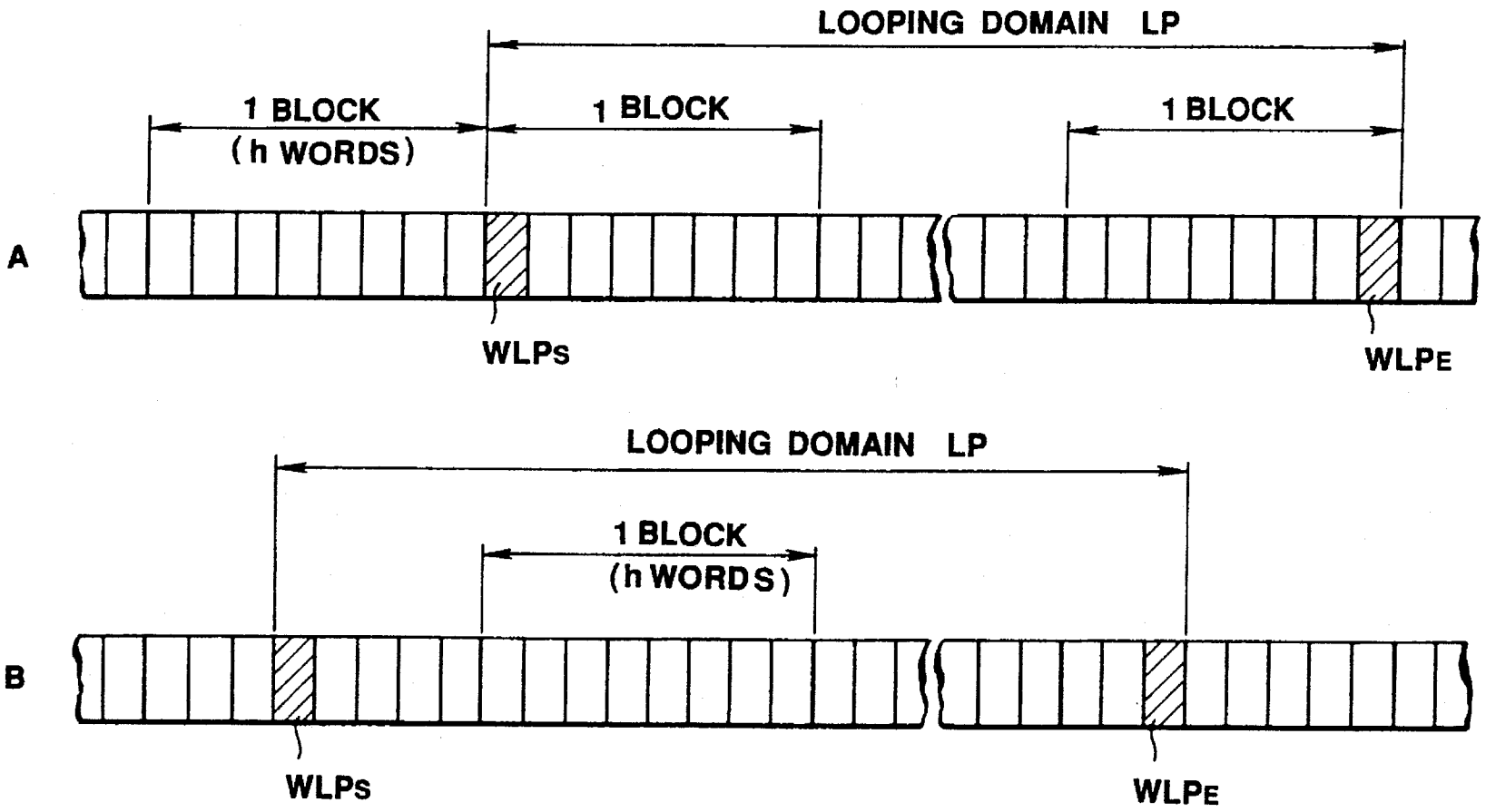
FIG. 15 is a diagrammatic view showing the construction of a block for quasi-instantaneous bit compression of wave height value data following time base correction.

FIG. 15 shows the structure of a block for the wave height value data of the waveform after time base correction which is subjected to bit compression and encoding as later described. The number of wave height value data for one block (number of samples or words) is h. In this case, pitch normalization consists of time base companding whereby the number of words within n periods of the waveform having a constant period $T_W$ of the musical sound signal waveform shown in FIG. 2, that is, within the looping period LP, will be an integral number multiple of or m times the number of words h in the block. More preferably, the pitch normalization consists of time base processing or shifting for coinciding the start point $LP_S$ and the end point $LP_E$ of the looping domain LP with the block boundary positions on the time axis. When the points $LP_S$ and $LP_E$ coincide in this manner with the block boundary positions, it becomes possible to reduce errors caused by block switching at the time of decoding by the bit compressing and encoding system.

Referring to FIG. 15A, words $WLP_S$ and $WLP_E$ each in a separate block indicate samples at the looping start point $LP_S$ and looping end point $LP_E$, or more precisely, the point immediately before $LP_E$, of the corrected waveform. When the shifting is not performed, the looping start point $LP_S$ and the looping end points $LP_E$ are not necessarily coincident with the block boundary, so that, as shown in FIG. 15B, the words $WLP_S$, $WLP_E$ are set at arbitrary positions within the blocks. However, the number of words from the word $WLP_S$ to the word $WLP_E$ is m number of times of the number of words h in one block, m being an integer, so that pitch normalizing is realized.

The time base companding of the musical signal waveform whereby the number of words within the looping domain LP is equal to an integer multiple of the number of words h in one block, may be achieved by various methods. For example, it may be achieved by interpolating the wave height value data of the sampled waveform, with the use of a filter for oversampling.

Meanwhile, when the looping period of an actual musical sound waveform is not a round number multiple of the sampling period such that an offset is produced between the sampling wave height value at the looping start point $LP_S$ and that at the looping end point $LP_E$, the wave height value coinciding with the sampling wave height value at the sampling start point $LP_S$ may be found in the vicinity of the looping end point $LP_E$, by interpolation with the use of, for example, oversampling, to realize the looping period, which is not a round number multiple of the sampling period when the interpolating sample is also included. Such looping period, which is not a round number multiple of the sampling period, may be set so as to be an integer multiple of the block period by the above described time base correcting operation. In case a time base companding is performed with the use of, for example, 256 times oversampling, the wave height value error between the looping start point $LP_S$ and the looping end point $LP_E$ may be reduced to 1/256 to realize more smooth looping reproduction.

Figure 16:
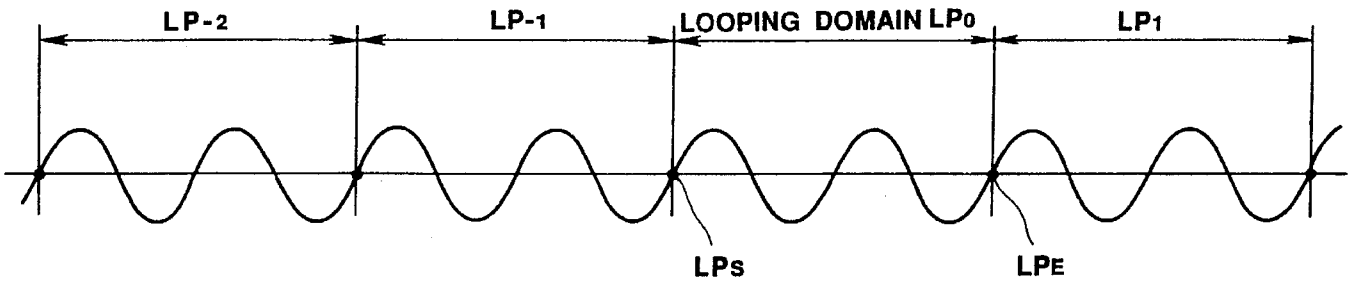
FIG. 16 is a waveform diagram showing the looping data obtained from a repetitive waveform between the looping points.

After the looping domain LP is determined and subjected to time base correction or companding as mentioned hereinabove, the looping domains LP are connected to one another as shown in FIG. 16 to produce looping data. FIG. 16 shows the loop data waveform obtained by taking out only the looping domain LP from the time base corrected musical sound waveform shown in FIG. 14B and arraying a plurality of such looping domains LP in juxtaposition to one another. The looping data waveform is obtained at a loop data generating block 21 by sequentially connecting the looping end points $LP_E$ of a given one of the looping domains LP with the looping start point $LP_S$ of another looping domain LP.

Since these loop data are formed by connecting the loop domains L a number of times, the start block including the word $WLP_S$ corresponding to the looping start point $LP_S$ of the loop data waveform (see FIG. 15) is directly preceded by the data of the end block including the word $WLP_S$ corresponding to the looping end point $LP_E$, or more precisely, the point immediately before the point $LP_E$. As a principle, in order for an encoding to be performed for bit compression and encoding, at least the end block must be present just ahead of the start block of the looping domain LP to be stored. More generally, at the time of bit compression and encoding on the block-by-block basis, the parameters for the start block, that is, data used for bit compression and encoding for each block, for example, ranging or filter selecting data as will be subsequently described, need only be formed on the basis of data of the start and the end blocks. This technique may also be applied to the case wherein the musical sound signal consisting only of loop data and devoid of a formant as subsequently described is used as the sound source.

By so doing, the same data are present for several samples before and after each of the looping start point $LP_S$ and the looping end point $LP_E$. Therefore, the parameters for bit compression and encoding in the blocks immediately preceding these points $LP_S$ and $LP_E$ are the same so that error or noises at the time of looping reproduction upon decoding may be reduced. Thus the musical sound data obtained upon looping reproduction are stable and free of junction noises. In the present embodiment, about 500 samples of the data are contained in the looping domain LP just ahead of the starting block.

Figure 17:
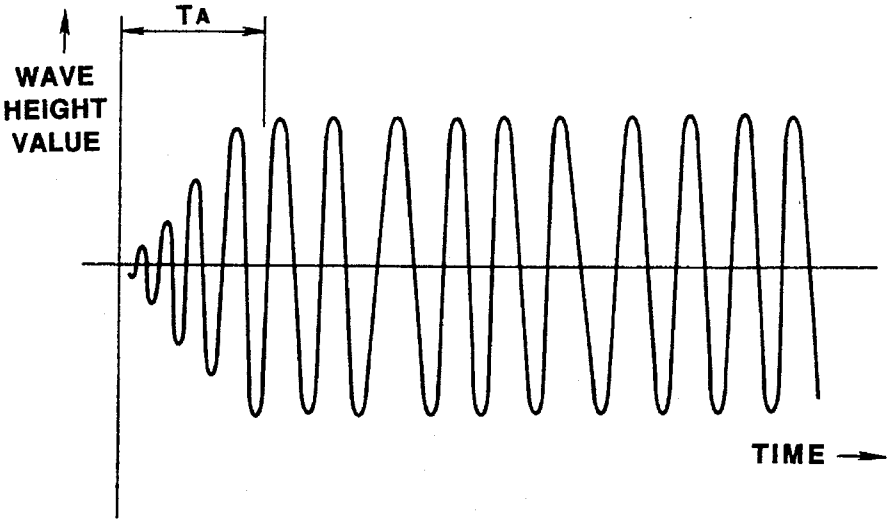
FIG. 17 is a waveform diagram showing formant portion producing data after envelope correction based on decay rate data.

In the process of signal data generation for the formant portion FR, envelope correction is performed at the block 18, as at the block 14 used at the time of looping data generation. The envelope correction at this time is performed by dividing the sampled musical sound signal by the envelope waveform (FIG. 6) consisting only of the decay rate data to produce the wave height value data of the signal having the waveform shown in FIG. 17. Thus, in the output signal of FIG. 17, only the envelope of the attack portion during the time $T_A$ is left while other portions are of the constant amplitude.

The envelope corrected signal is filtered, if necessary, at the block 19. For filtering at the block 19, the comb filter having frequency characteristics shown for example by the chain dotted line in FIG. 10 is employed. This comb filter has such frequency characteristics that the frequency band components that are whole number multiples of the fundamental frequency $f_0$ are enhanced, whereas, by comparison, the non-tone components are attenuated. The frequency characteristics of the comb filter are also established on the basis of the pitch data (fundamental frequency $f_0$) detected at the pitch detection block 12. These data are used for producing signal data of the formant portion in the sound source data ultimately recorded on the storage medium, such as the memory.

In the next block 20, time base correction similar to that performed in the block 17 is performed on the formant portion generating signal. The purpose of this time base correction is to match or normalize the pitches for the sound sources by companding the time base on the basis of the pitch conversion ratio found in the block 16 or the pitch data detected in the block 12.

In the mixing block 22, the formant portion generating data and the loop data, corrected by using the same pitch conversion ratio or pitch data, are mixed together. For such mixing, a Hamming window is applied to the formant portion generating signal from the block 20, a fade-out type signal decaying with time at the portion to be mixed with the loop data is formed, a similar Hamming window is applied to the loop data from the block 20, a fade-in type signal increasing with time at the portion to be mixed with the formant signal is formed and the two signals are mixed (or cross-faded) to produce a musical sound signal which will ultimately prove to be the sound source data. As the loop data to be stored in the storage medium, such as memory, data of a looping domain spaced to some extent from the cross-faded portion may be taken out to reduce the noise during looping reproduction (looping noise). In this manner, wave height value data of a sound source signal consisting of the looping domain LP which is the repetitive waveform portion consisting only of the tone component and the formant portion FR which is a waveform portion containing non-tone components since the sound generation, is produced.

The starting point of the loop data signal may also be connected to the looping start point of the formant forming signal.

For detecting the looping domain, looping or mixing the formant portion and the loop data, rough mixing is performed by manual operation with trial hearing and a more accurate processing is then performed on the basis of the data on the looping points, that is, the looping start point $LP_S$ and the looping end point $LP_E$.

Figure 18:
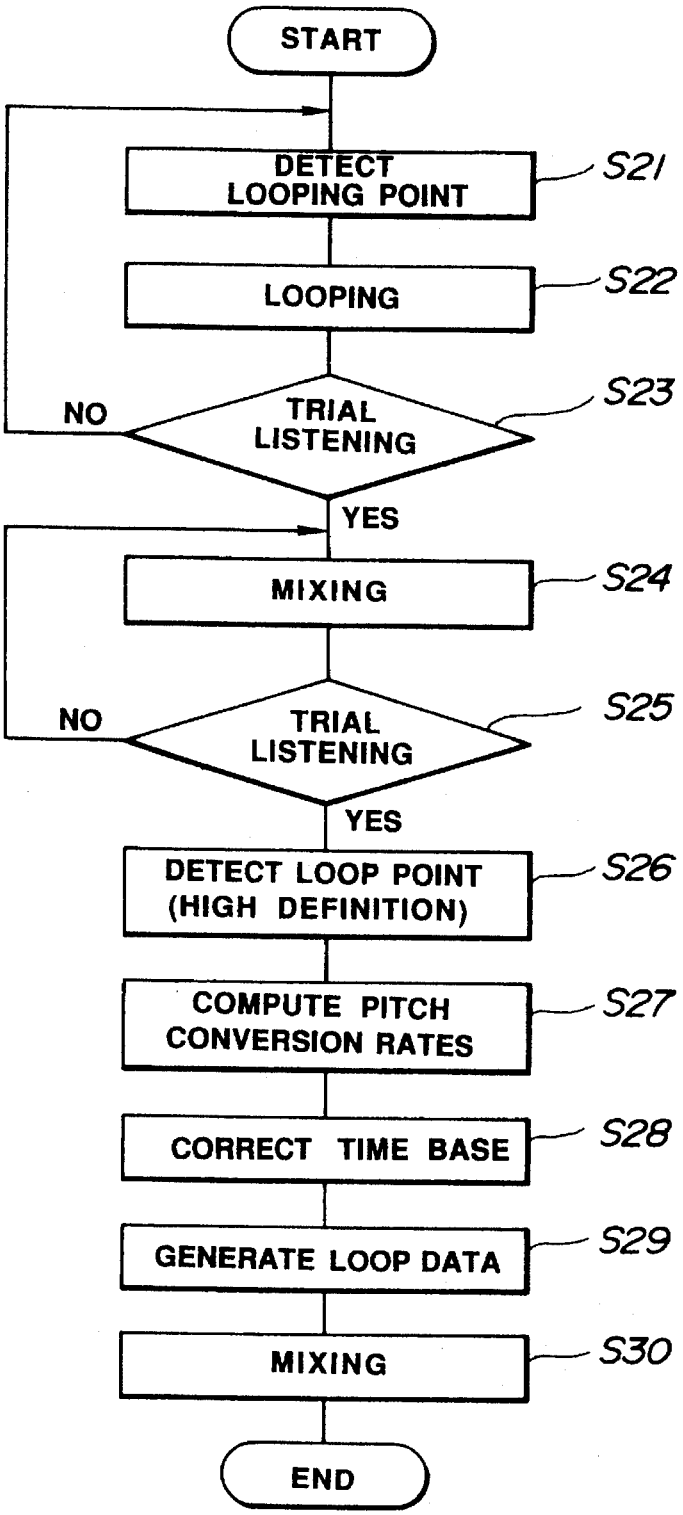
FIG. 18 is a flow chart for illustrating the operation before and after looping.

That is, before more precise loop domain detection in the block 16, loop domain detection and mixing is performed by manual operation with trial hearing in accordance with the procedure shown in the flow chart of FIG. 18, after which the above described high definition procedure is performed at step S26 et seq.

Referring to FIG. 18, the looping points are detected at step S21 with low definition by utilizing zero-crossing points of the signal waveform or visually checking the indication of the signal waveform. At step S22, the waveform between the looping points is repeatedly reproduced by looping. At the next step S23, it is checked by trial hearing whether the looping is in a proper state. If not, the program reverts to step 521 to detect again the looping points. This operational sequence is repeated until a satisfactory result is obtained. If the result is satisfactory, the program proceeds to step S24 where the waveform is mixed such as by cross-fading with the formant signal. At the next step S23, it is again decided by trial hearing whether the shifting from the formant to the looping has been in a proper state. If not, the program returns to step S24 for re-mixing. The program then proceeds to step S26 where the high definition loop domain detection at the block 16 is performed. This includes, detection of the loop domain including the interpolating sample, for example, loop domain detection at the definition of 1/256 of the sampling period in case of, for example, 256 times oversampling. At the next step S27, the pitch conversion ratio for pitch normalization is computed. At the next step S28, time base correction at the blocks 17 and 20 is performed. At the next step S29, loop data generation at the block 21 is performed. At the next step S30, mixing of the block 22 is performed. The operations since the step S26 are performed with the use of the looping points obtained at the steps S21 to S25. The steps S21 to S25 may be omitted for fully automating the looping.

The wave height value data of the signal consisting of the formant portion FR and the looping domain LP, obtained upon such mixing, are processed at the next block 23 by bit compression and encoding.

Although various bit compressing and encoding systems may be employed, the preferred embodiment includes a quasi-instant companding type high efficiency encoding system, as proposed by the present Assignee in the JP Patent KOKAI Publications 62-008629 and 62-003516, in which a predetermined number of h-sample words of wave height value data are grouped in a block and subjected to bit compression on the block-by-block basis. This high efficiency bit compression and encoding system is briefly explained by referring to FIG. 19.

In this figure, the bit compression and encoding system is formed by an encoder 70 at the recording side and a decoder 90 at the reproducing side. The wave height value data x(n) of the sound source signal is supplied to an input terminal 71 of the encoder 70.

The wave height value data x(n) of the input signal are supplied to a FIR type digital filter 74 formed by a predictor 72 and a summing point 73. The wave height value data $\tilde{x}(n)$ of the prediction signal from the predictor 72 is supplied as a subtraction signal to the summing point 73. At the summing point 73, the prediction signal $\tilde{x}(n)$ is subtracted from the input signal x(n) to produce a prediction error signal or a differential output d(n) in the broad sense of the term. The predictor 72 computes the predicted value $\tilde{x}(n)$ from the primary combination of the past p number of inputs x(n−p), x(n−p+1), . . . , x(n−1). The FIR filter 74 is referred to hereinafter as the encoding filter.

With the above described high efficiency bit compression and encoding system, the sound source data occurring within a predetermined time, that is, input data consisting of a predetermined number h of words, are grouped into blocks, and the encode filter 74 having optimum characteristics are selected for each block. This may be realized by providing a plurality of, for example, four filters having different characteristics in advance and selecting the one of the filters which has optimum characteristics, that is, which enables the highest compression ratio to be achieved. In practice, the equivalent operation is usually achieved by storing a set of coefficients of the predictor 72 of the encode filter 74 shown in FIG. 19 in a plurality of, herein four, sets of coefficient memories, and time-divisionally switching and selecting one of the coefficients of the set.

The difference output d(n) as the predicted error is transmitted via summing point 81 to a bit compressor consisting of a gain G shifter 75 and a quantizer 76 where a compression or ranging is performed so that the index part and the mantissa part under the floating decimal point notation correspond to the gain G and the output from the quantizer 76, respectively. That is, a re-quantization is performed in which the input data is shifted by the shifter 75 by a number of bits corresponding to the gain G to switch the range and a predetermined number of bits of the bit shifted data is taken out by the quantizer 76. The noise shaping circuit 77 operates in such a manner that the quantization error between the output and the input of the quantizer 76 is produced at the summing point 81 and transmitted via a gain $G^{-1}$ shifter 79 to a predictor 80 and the prediction signal of the quantization error is fed back to the summing point 81 as a subtraction signal to perform a so-called error feedback operation. After such re-quantization by the quantizer 76 and the error feedback by the noise shaping circuit 77, an output $\hat{d}(n)$ is taken out at an output terminal 82.

The output d'(n) from the summing point 81 is the difference output d(n) less the prediction signal e(n) of the quantization error from the noise shaping circuit 77, whereas the output d"(n) from the gain G shifter 75 is the output d'(n) from the output summing point 81 multipled by the gain G. On the other hand, the output $\hat{d}(n)$ from the quantizer 76 is the sum of the output d"(n) from the shifter 75 and the quantization error e(n) produced during the quantization process. The quantization error e(n) is taken out at the summing point 78 of the noise shaping circuit 77. After passing through the gain $G^{-1}$ shifter 79 and the predictor 80 taking the primary combination of the past r number of inputs, the quantization error e(n) is turned into the prediction signal $\tilde{e}(n)$ of the quantization error.

After the above described encoding operation, the sound source data is turned into the output $\hat{d}(n)$ from the quantizer 76 and taken out at the output terminal 82.

From a prediction range adaptive circuit 84, mode selection data as the optimum filter selection data are outputted and transmitted to, for example, the predictor 72 of the encode filter 74 and an output terminal 87, whereas range data for determining the bit shift quantity or the gains G and $G^{-1}$ are also outputted and transmitted to shifters 75 and 79 and to an output terminal 86.

The input terminal 91 of the decoder 90 at the reproducing side is supplied with the signal $\hat{d}'(n)$ which is obtained by transmitting, or recording and reproducing the output $\hat{d}(n)$ from the output terminal 82 of the encoder 70. This input signal $\hat{d}'/(n)$ is supplied to a summing point 93 via a gain $G^{-1}$ shifter 92. The output x'(n) from the summing point 93 is supplied in a feed back loop to a predictor 94 and thereby turned into a prediction signal $\tilde{x}(n)$ which then is supplied to the summing point 93 and summed to the output $\hat{d}''/(n)$ from the shifter 92. This sum signal is outputted as a decode output x'(n) at an output terminal 95.

The range data and the mode select signal outputted, transmitted, or recorded and reproduced at the output terminals 86 and 87 of the encoder 70 are entered to input terminals 96 and 97 of the decoder 90. The range data from the input terminal 96 are transmitted to the shifter 92 to determine the gain $G^{-1}$, whereas the mode select data from the input terminal 97 are transmitted to a predictor 94 to determine prediction characteristics. These prediction characteristics of the predictor 94 are selected so as to be equal to those of the predictor 72 of the encoder 70.

With the above described decoder 90, the output $\hat{d}''(n)$ from the shifter 92 is the product of the input signal $\hat{d}'(n)$ times the gain $G^{-1}$. On the other hand, the output x'/(n) from the summing point 93 is the sum of the output $\hat{d}''(n)$ from the shifter 92 and the prediction signal $\tilde{x}'(n)$.

Figures 20, 21:
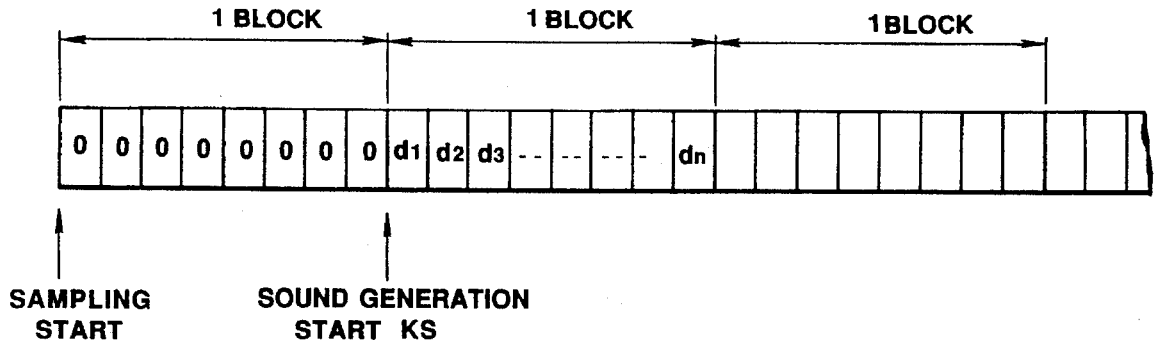
FIG. 20 is a diagrammatic view showing a practical example of a data block produced upon quasi-instantaneous bit compression and encoding.
FIG. 21 is a diagrammatic view showing the contents of leading part blocks of a musical signal.

FIG. 20 shows an example of one-block output data from the bit compressing encoder 70 which is composed of 1-byte header data (parameter data concerning compression, or sub-data) RF and 8-byte sampling data $D_{A0}$ to $D_{B3}$. The header data RF is made up of the 4-bit range data, 2-bit mode selection data or filter selection data and two 1-bit flag data, such as data LI indicating the presence or absence of the loop and data EI indicating whether the end block of the waveform is negative. Each sample of the wave height value data is represented after bit compression by four bits, while 16 samples of 4-bit data $D_{A0H}$ to $D_{B3L}$ are contained in the data $D_{A0}$ to $D_{B3}$.

FIG. 21 shows each block of the quasi-instantly bit compressed and encoded wave height value data corresponding to the leading part of the musical sound signal waveform shown in FIG. 2. In FIG. 21, only the wave height value data are shown with the exclusion of the header. Although each block is here shown formed by eight samples for simplicity of illustration, it may be formed by any other number of samples, such as 16 samples. This may apply for the case of FIG. 15.

The quasi-instantaneous bit compressing and encoding system selects the one of the straight PCM mode consisting of directly outputting the input musical sound signal, a first order differential filter mode, or a second order differential filter mode, each consisting of outputting the musical sound signal by way of a filter, which will give signals having the highest compression ratio, to transmit musical sound data which is the output signal.

When sampling and recording a musical sound on a storage medium, such as a memory, inputting of the waveform of the musical sound is started at a sound generation start point KS. When the first or second order differential filter mode, both in need of an initial value, is selected at the first block since the sound generation start point KS, it is necessary to set the initial value in store. It is however desirable to dispense with such initial value. For this reason, pseudo input signals which will cause the straight PCM mode to be selected is affixed during the period preceding the sound generation start point KS and signal processing is then performed so that these pseudo signals will be processed with the input data.

More specifically, in FIG. 21, a block containing all "0" as the pseudo input signals is placed ahead of the sound generation start point KS and the data "0" from the leading part of the block are bit compressed as the wave height value data and entered as the input signal. This may be achieved by providing a block containing all "0" bits and storing it in a memory, or by starting the sampling of the musical sound at the input signal containing all "0" bits ahead of the start point KS, that is, the silent part preceding the sound generation. At least one block of the pseudo input signal is required in any case.

Figure 19:
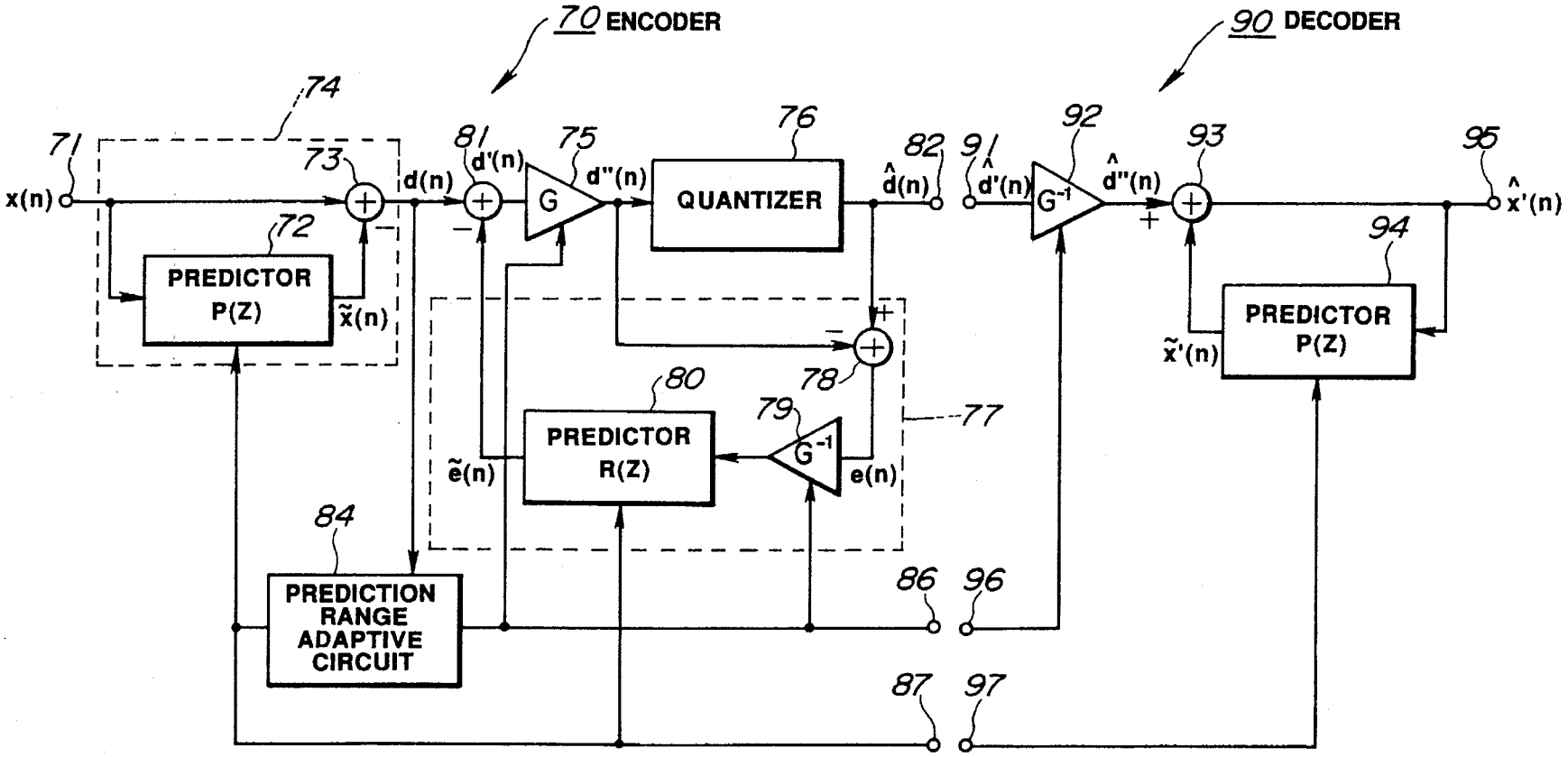
FIG. 19 is a block diagram showing a schematic construction of a quasi-instantaneous bit compressing and encoding system.

The musical sound data inclusive of the thus formed pseudo input signals are compressed by the high efficiency bit compression and encoding system shown in FIG. 19 and recorded in a suitable recording medium, such as a memory, and the thus compressed signal is reproduced.

Thus, when reproducing the musical sound data containing the pseudo input signal, the straight PCM mode is selected for the filter upon starting the reproduction of the block of the pseudo input signals, so that it becomes unnecessary to set the initial values for the primary or secondary differential filters in advance.

There may be raised a question concerning the delay in the sound generation start time by the pseudo input signal upon starting the reproduction, which signal is silent since the data are all zero. However, this is not inconvenient since, with the sampling frequency of 32 kHz and with a 16-sample blocks, the delay in the sound generation is about 0.5 msec which cannot be audibly discerned.

Figure 22:
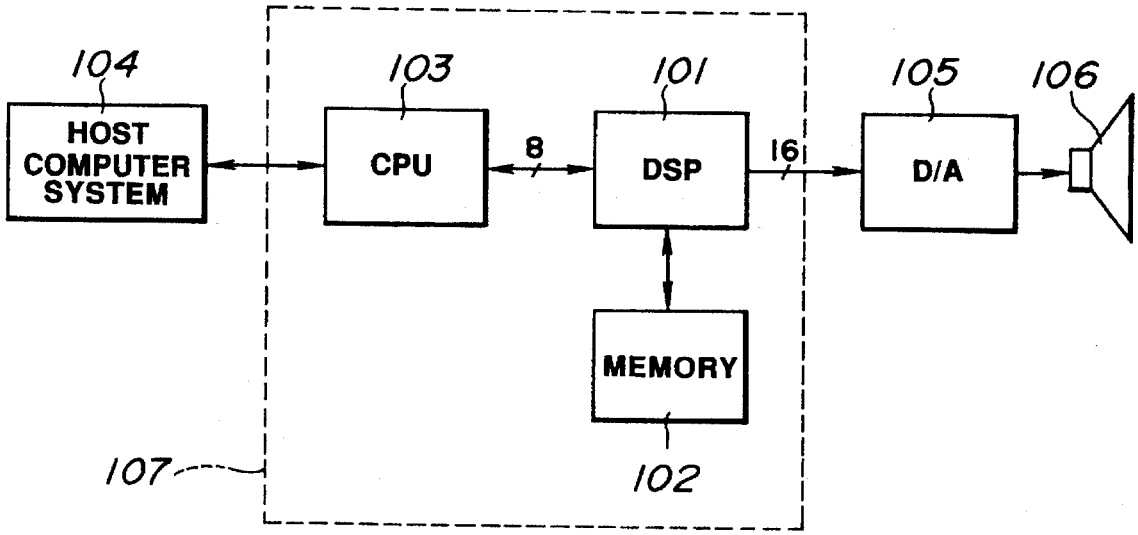
FIG. 22 is a block diagram showing an example of a system including an audio processing unit (APU) with its periphery.

The above described bit compression and encoding and other digital signal processing for sound source data generation is achieved in many cases by a software technique using a digital signal processor (DSP). FIG. 22 shows, by way of an example, the overall construction of an audio processing unit (APU) 107 as a sound source unit handling the sound source data, inclusive of peripheral devices.

In this figure, a host computer 104, provided in a customary personal computer, a digital electronic musical instrument or a TV game set, is connected to the APU 107 as the sound source unit, so that sound source data are loaded from the host computer 104 into the APU 107. The APU 107 is at least mainly composed of a central processing unit or CPU 103, such as a micro-processor, a digital signal processor or DSP 101 and a memory 102 storing the sound source data. Thus, at least the sound source data are stored in the memory 102, and a variety of processing operations, inclusive of read-out control, of the sound source data, such as looping bit expansion or restoration, pitch conversion, envelope addition or echoing (reverberation), is performed by the DSP 101. The memory 102 is also used as the buffer memory for performing these various processing operations. The CPU 103 controls the contents or manner of these processing operations performed by the DSP 101.

The digital musical sound data, ultimately produced after these various processing operations by the DSP 101 of the sound source data from the memory 102, is converted by a digital-to-analog (D/A) converter 105 before being supplied to a speaker 106.

The present invention is not limited to the above described embodiments which are given only by way of illustration and examples. For example, the sound source data are formed in the above described embodiments by connecting the formant portion and the looping domain to each other. However, the present invention may be applied to the case of forming sound source data consisting only of the looping domains. The decoder side devices or the external memory for the sound source data may also be supplied as a ROM cartridge or adapter. The present invention may be applied not only to the sound source, but speech synthesis well.

What is claimed is:

1. A method for producing a digital signal comprising the steps of:

(a) converting an analog signal having repetitive waveforms into a digital signal composed of plural samples at a predetermined sampling period;

(b) detecting (i) the values of predetermined evaluation functions of samples at a plurality of sets of two points relatively spaced apart by a repetitive period of said analog signal, and (ii) a plurality of samples in the vicinity of said sets; and (c) electronically extracting plural samples between two points of one of said sets the evaluation functions of which have values indicating a high similarity of the waveforms in the vicinity of said two points.

2. A method for producing a digital signal representative of an analog audio signal having repetitive waveforms comprising;

(a) converting the analog signal into a digital signal composed of plural samples by sampling at a predetermined sampling period;

(b) finding values of predetermined evaluation functions of a plurality of sets of samples each set having two points relatively spaced apart by a repetitive period of the analog signal; and (c) extracting plural samples between two points of one of the sets the evaluation functions of which have values indicating a high similarity of the waveforms in a vicinity of the two points.

* * * * *